US007434394B2

(12) United States Patent
Ishikawa et al.

(10) Patent No.: US 7,434,394 B2
(45) Date of Patent: Oct. 14, 2008

(54) HYDRAULIC DRIVE DEVICE

(75) Inventors: Kouji Ishikawa, Niihari-gun (JP); Yusuke Kajita, Ushiku (JP); Kazunori Nakamura, Tsuchiura (JP); Genroku Sugiyama, Ryugasaki (JP); Hideo Karasawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 143 days.

(21) Appl. No.: 10/553,414

(22) PCT Filed: Apr. 16, 2004

(86) PCT No.: PCT/JP2004/005472

§ 371 (c)(1),
(2), (4) Date: Oct. 6, 2006

(87) PCT Pub. No.: WO2004/092491

PCT Pub. Date: Oct. 28, 2004

(65) Prior Publication Data

US 2007/0028607 A1 Feb. 8, 2007

(30) Foreign Application Priority Data

Apr. 17, 2003 (JP) ..... 2003-113323

(51) Int. Cl.
*F16D 31/02* (2006.01)
*F15B 13/06* (2006.01)

(52) U.S. Cl. ..... 60/424; 60/413; 91/452; 91/517; 91/520

(58) Field of Classification Search ..... 60/413, 60/414, 424; 91/DIG. 2, 444, 452, 511, 517, 91/520

See application file for complete search history.

(56) References Cited

U.S. PATENT DOCUMENTS

| | | | | |
|---|---|---|---|---|
| 6,898,932 | B2 * | 5/2005 | Kajita | 60/424 |
| 7,059,237 | B2 * | 6/2006 | Ioku et al. | 91/515 |
| 7,127,888 | B2 * | 10/2006 | Kajita et al. | 60/424 |

FOREIGN PATENT DOCUMENTS

| | | |
|---|---|---|
| JP | 08-219121 | 8/1996 |
| JP | A-2000-337307 | 12/2000 |
| JP | 2002-031104 | 1/2002 |
| JP | 2003-120604 | 4/2003 |

* cited by examiner

*Primary Examiner*—Michael Leslie
(74) *Attorney, Agent, or Firm*—Crowell & Moring LLP

(57) ABSTRACT

To permit using hold-side pressure oil in a first hydraulic cylinder for the acceleration of a second hydraulic cylinder upon performing a combined operation of the first and second hydraulic cylinders, a hydraulic drive system is provided with a main hydraulic pump 21, a boom cylinder 6 and an arm cylinder 7, a directional control valve 23 for a boom and a directional control valve 24 for an arm, and a boom control device 25 and an arm control device 26. The hydraulic drive system is also provided with a pressure oil feed means for feeding pressure oil in a rod chamber 6*b* of the boom cylinder 6 to an upstream side of the directional control valve 24 for the arm when a bottom pressure of the arm cylinder 7 has increased to a high pressure equal to or higher than a predetermined pressure. This pressure oil feed means includes a flow combiner valve 44 arranged in a reservoir line 42 which can communicate to the rod chamber 6*b* of the boom cylinder 6. When the bottom pressure of the arm cylinder 7 is the predetermined pressure or higher, the flow combiner valve 44 maintains a communication line 40, which communicates the reservoir line 42 and the upstream side of the directional control valve 24 for the arm with each other, in a state that pressure oil can be fed to the upstream side of the directional control valve 24 for the arm.

14 Claims, 13 Drawing Sheets

HYDRAULIC DRIVE DEVICE

FIELD OF THE INVENTION

This invention relates to a hydraulic drive system mounted on a construction machine such as a hydraulic excavator to permit a combined operation of plural hydraulic cylinders.

BACKGROUND OF THE INVENTION

As a hydraulic drive system mounted on a construction machine to perform combined operations of plural hydraulic cylinders, many techniques have been proposed to date (for example, JP-A-2000-337307).

FIG. 11 is a hydraulic circuit diagram showing the construction of an essential part of a hydraulic drive system arranged in this kind of conventional techniques, and FIG. 12 is a side view illustrating a hydraulic excavator on which the hydraulic drive system shown in FIG. 11 is arranged.

The hydraulic excavator illustrated in FIG. 12 is provided with a travel base 1, a swing superstructure 2 arranged on the travel base 1, a boom 3 mounted pivotally in a vertical direction on the swing superstructure 2, an arm 4 mounted pivotally in a vertical direction on the boom 3, and a bucket 5 mounted pivotally in a vertical direction on the arm 4. The boom 3, arm 4 and bucket 5 make up front attachments. The hydraulic excavator is also provided with a boom cylinder 6 which constitutes a first hydraulic cylinder for driving the boom 3, an arm cylinder 7 which constitutes a second hydraulic cylinder for driving the arm 4, and a bucket cylinder 8 for driving the bucket 5.

FIG. 11 shows a center-bypass hydraulic drive system for driving the boom cylinder 6 and arm cylinder 7 in the above-mentioned hydraulic drive systems suitable for arrangement on hydraulic excavators.

As shown in FIG. 11, the boom cylinder 6 is provided with a bottom chamber 6*a* and a rod chamber 6*b*. By feeding pressure oil to the bottom chamber 6*a*, the boom cylinder 6 is caused to extend to perform boom raising. By feeding pressure oil to the rod chamber 6*b*, on the other hand, the boom cylinder 6 is caused to retract to perform boom lowering. The arm cylinder 7 is also provided with a bottom chamber 7*a* and rod chamber 7*b*. By feeding pressure oil to the bottom chamber 8*a*, arm crowding is performed. By feeding pressure oil to the rod chamber 7*b*, on the other hand, arm dumping is performed.

The hydraulic drive system which includes these boom cylinder 6 and arm cylinder 7 is provided with an engine 20, a main hydraulic pump 21 driven by the engine 20, a directional control valve 23 for the boom as a first directional control valve for controlling a flow of pressure oil to be fed from the main hydraulic pump 21 to the boom cylinder 6, an directional control valve 24 for the arm as a second directional control valve for controlling a flow of pressure oil to be fed from the main hydraulic pump 21 to the arm cylinder 7, a boom control device 25 as a first control device for selectively controlling the directional control valve 23 for the boom, an arm control device 26 as a second control device for selectively controlling the directional control valve 24 for the arm, and a pilot pump 22 driven by the engine 20.

The directional control valve 23 for the boom is arranged on a line 28 extending to a delivery line of the main hydraulic pump 21, while the directional control valve 24 for the arm is arranged on a line 27 extending to the above-mentioned delivery line.

The directional control valve 23 for the boom and the bottom chamber 6*a* of the boom cylinder 6 are connected via a main line 29*a*, while the directional control valve 23 for the boom and the rod chamber 6*b* of the boom cylinder 6 are connected via a main line 29*b*. Similarly, the directional control valve 24 for the arm and the bottom chamber 7*a* of the arm cylinder 7 are connected via a main line 30*a*, while the directional control valve 24 for the arm and the rod chamber 7*b* of the arm cylinder 7 are connected via a main line 30*b*.

The boom control device 25 is connected to the pilot pump 22. A pilot pressure produced as a result of its operation is fed via one of pilot lines 25*a*,25*b* to a corresponding control chamber of the directional control valve 23 for the boom such that the directional control device 23 for the boom is changed over into the left position or the right position as viewed in FIG. 11. Similarly, the arm control device 26 is also connected to the pilot pump 22. A pilot pressure produced corresponding to a control stroke is fed via one of pilot lines 26*a*,26*b* to a corresponding control chamber of the directional control valve 24 for the arm such that the directional control device 24 for the arm is changed over into the left position or the right position as viewed in FIG. 11.

In the hydraulic excavator provided with the hydraulic drive system constructed as described above, the boom control device 25 shown in FIG. 11 is controlled upon performing digging or the like of earth, and a pilot pressure is hence produced, for example, in the pilot line 25*a*. When the directional control valve 23 for the boom is changed over into the left position as viewed in FIG. 11, the pressure oil delivered from the main hydraulic pump 21 is fed to the bottom chamber 6*a* of the boom cylinder 6 via the line 28, the directional control valve 23 for the boom and the main line 29*a*, while the pressure oil in the rod chamber 6*b* is caused to return to a reservoir 43 via the main line 29*b* and the directional control valve 23 for the boom. As a result, the boom cylinder 6 extends as indicated by arrow 13 in FIG. 12 so that the boom 3 is pivoted as indicated by arrow 12 in FIG. 12 to perform boom raising.

Concurrently with this boom raising operation, the arm control device 26 is also controlled and a pilot pressure is hence produced, for example, in the pilot line 26*a*. when the directional control valve 24 for the arm is changed over into the left position as viewed in FIG. 11, the pressure oil delivered from the main hydraulic pump 21 is fed to the bottom chamber 7*a* of the arm cylinder 7 via the line 27, the directional control valve 24 for the arm and the main line 30*a*, while the pressure oil in the rod chamber 7*b* is caused to return to the reservoir 43 via the main line 30*b* and the directional control valve 24 for the arm. As a result, the arm cylinder 7 extends as indicated by arrow 9 in FIG. 12 so that the arm 4 is pivoted as indicated by arrow 11 in FIG. 12 to perform arm crowding.

When an unillustrated bucket control device is also controlled concurrently with such a boom raising and arm crowding operation to change over a directional control valve for the bucket such that the bucket cylinder 8 illustrated in FIG. 12 is caused to extend in the direction of arrow 10 in FIG. 12, the bucket 5 is caused to pivot in the direction of arrow 11 to perform earth digging work or the like as desired.

FIG. 13 contains characteristic diagrams illustrating pilot pressure characteristics and cylinder pressure characteristics in the above-described combined operation. In the lower diagram of FIG. 13, the time length of digging work is plotted along abscissas, and the pilot pressure produced by the control device is plotted along ordinates. Numeral 31 in the lower diagram of FIG. 13 indicates pilot pressures produced by the arm control device 26 and to be fed to the pilot line 26*a*, while numeral 32 in the lower diagram of FIG. 13 designates pilot pressures produced by the boom control device 25 and to be fed to the pilot line 25*a*, that is, pilot pressures upon boom raising. T1, T2 and T3 indicate time points at which boom raising operations were performed, respectively.

In the upper diagram of FIG. 13, on the other hand, time lengths of digging work are plotted along abscissas, and load pressures produced in the hydraulic cylinders 6, 7, in other words, cylinder pressures are plotted along ordinates. Numeral 33 in the upper diagram of FIG. 13 indicates bottom pressures produced in the bottom chamber 7*a* of the arm cylinder 7, that is, arm cylinder bottom pressures, while numeral 34 designates rod pressures produced in the rod chamber 6*b* of the boom cylinder 6, that is, boom cylinder rod pressures. When such a combined operation of boom raising and arm crowding is performed, force in the direction of arrow 12 in FIG. 12 is transmitted to the boom 3 by counterforce produced when the bucket 5 digs earth. As a consequence, the boom cylinder 6 tends to be pulled in the direction of arrow 13 in FIG. 12, and as indicated by the boom rod pressure 34 in the upper diagram of FIG. 13, a high pressure is produced in the rod chamber 6*b* of the boom cylinder 6.

SUMMARY OF THE INVENTION

In the above-described conventional art shown in FIG. 11, earth digging work or the like can be performed without a problem by combined operations of boom raising and arm crowding. Nonetheless, it is desired to achieve more efficient work.

The present inventors' attention was attracted to the current situation that the pressure oil, that is, the hold-side pressure oil in the rod chamber 6*b* of the first hydraulic cylinder as the boom cylinder 6 had been drained directly to the reservoir 43 and had not been used upon performing the above-described combined operation of boom raising and arm crowding, namely when pressure oil was fed to both of the bottom chambers 6*a*,7*a* of the first hydraulic cylinder as the boom cylinder 6 and the second hydraulic cylinder as the arm cylinder 7, their drive-side pressures increased, and an operation which would lead to development of a higher rod pressure in the first hydraulic cylinder as the boom cylinder 6 was performed.

In the foregoing, the description was made about the combined operation of boom raising and arm crowding. A similar situation also arises when an earth-pushing operation is performed by a combined operation of boom raising and arm dumping that pressure oil is fed to the rod chamber 7*b* of the arm cylinder 7 as the second hydraulic cylinder and its drive-side pressure increases accordingly. In such a situation, the pressure oil, that is, the hold-side pressure oil in the rod chamber 6*b* of the first hydraulic cylinder as the boom cylinder 6 has been drained directly to the reservoir 43 and has not been used, conventionally.

The present invention has been completed in view of the above-described situation of the conventional art, and as an object, has the provision of a hydraulic drive system which makes it possible to effectively use the hold-side pressure oil in the first hydraulic cylinder for the acceleration of the second hydraulic cylinder upon performing a combined operation of the first and second hydraulic cylinders.

To achieve the above-described object, the present invention is characterized in that in a hydraulic drive system provided with a main hydraulic pump, a first hydraulic cylinder and second hydraulic cylinder driven by pressure oil delivered from the main hydraulic pump, a first directional control valve for controlling a flow of pressure oil to be fed from the main hydraulic pump to the first hydraulic cylinder, a second directional control valve for controlling a flow of pressure oil to be fed from the main hydraulic pump to the second hydraulic cylinder, a first control device for selectively controlling the first directional control valve and a second control device for selectively controlling the second directional control valve, the hydraulic drive system is provided with a pressure oil feed means for feeding hold-side pressure oil in the first hydraulic cylinder to an upstream side of the second directional control valve when a drive-side pressure of the second hydraulic cylinder has increased to a high pressure equal to or higher than a predetermined pressure.

According to the present invention constructed as described above, upon performing a combined operation of the first hydraulic cylinder and the second hydraulic cylinder by controlling the first control device and second control device to change over the first directional control valve and second directional control valve, respectively, and feeding the pressure oil from the main hydraulic pump to the first hydraulic cylinder and second hydraulic cylinder via the first directional control valve and second directional control valve, respectively, the pressure oil feed means is operated to feed the hold-side pressure oil in the first hydraulic cylinder to the upstream side of the second directional control valve when the drive-side pressure of the second hydraulic cylinder has increased to a high pressure equal to or higher than the predetermined pressure. Therefore, the pressure oil delivered from the main hydraulic pump and the pressure oil fed from the first hydraulic cylinder are combined and fed to the second hydraulic cylinder via this second directional control valve. This makes it possible to perform an acceleration of the second hydraulic cylinder. As appreciated from the foregoing, the hold-side pressure oil of the first hydraulic cylinder can be selectively used for the acceleration of the second hydraulic cylinder although the hold-side pressure oil has heretofore been simply drained to a reservoir.

The present invention is also characterized in that in the above-described invention, the main hydraulic pump comprises a first hydraulic pump capable of feeding pressure oil to the first hydraulic cylinder and the second hydraulic cylinder and a second hydraulic pump capable of feeding pressure oil to the first hydraulic cylinder, the first directional control valve comprises two directional control valves, one being interposed between the first pump and the first hydraulic cylinder, and the other being interposed between the second pump and the first hydraulic cylinder, and the second directional control valve comprises two directional control valves, one being interposed between the first pump and the second hydraulic cylinder, and the other being interposed between the second pump and the second hydraulic cylinder.

According to the present invention constructed as described above, upon performing a combined operation of the first hydraulic cylinder and the second hydraulic cylinder by controlling the first control device and second control device to change over the two directional control valves, which make up the first directional control valve, and the two directional control valves, which make up the second directional control valve, respectively, and feeding the pressure oils from the first pump and the second pump to the first hydraulic cylinder, for example, via one of the two directional control valves, which make up the first directional control valve, and to the second hydraulic cylinder, for example, via one of the two directional control valves, which make up the second directional control valve, the pressure oil feed means is operated to feed the hold-side pressure oil in the first hydraulic cylinder to the upstream side of the second directional control valve when the drive-side pressure of the second hydraulic cylinder has increased to a high pressure equal to or higher than the predetermined pressure. This makes it possible to perform an acceleration of the second hydraulic cylinder.

The present invention is also characterized in that in a hydraulic drive system provided with a main hydraulic pump, a first hydraulic cylinder and second hydraulic cylinder driven by pressure oil delivered from the main hydraulic pump, a first directional control valve for controlling a flow of pressure oil to be fed from the main hydraulic pump to the first hydraulic cylinder, a second directional control valve for controlling a flow of pressure oil to be fed from the main hydraulic pump to the second hydraulic cylinder, a first control device for selectively controlling the first directional control valve and a second control device for selectively controlling the second directional control valve, the hydraulic drive system is provided with a pressure oil feed means for feeding hold-side pressure oil in the first hydraulic cylinder to an upstream side of the second directional control valve when the second control device has been controlled over at least a predetermined stroke.

According to the present invention constructed as described above, upon performing a combined operation of the first hydraulic cylinder and the second hydraulic cylinder by controlling the first control device and second control device to change over the first directional control valve and the second directional control valve, respectively, and feeding the pressure oil from the main pump to the first hydraulic cylinder and the second hydraulic cylinder via the first directional control valve and the second directional control valve, respectively, the pressure oil feed means is operated to feed the hold-side pressure oil in the first hydraulic cylinder to the upstream side of the second directional control valve when the second control device is controlled over at least the predetermined stroke, in other words, when the drive-side pressure of the second hydraulic cylinder has increased. Accordingly, the pressure oil delivered from the main hydraulic pump and the pressure oil fed from the first hydraulic cylinder are combined and fed to the second hydraulic cylinder via the second directional control valve. This makes it possible to perform an acceleration of the second hydraulic cylinder. As described above, the hold-side pressure oil in the first hydraulic cylinder, which has conventionally been drained into the reservoir, can be selectively used for the acceleration of the second hydraulic cylinder.

The present invention is also characterized in that in the above-described invention, the pressure oil feed means feeds the hold-side pressure oil in the first hydraulic cylinder to the upstream side of the second directional control valve when a delivery pressure of the main hydraulic pump has increased to a high pressure equal to or higher than a predetermined pressure.

According to the present invention constructed as described above, the pressure oil feed means is operated when the control stroke of the second control device has been controlled over the predetermined stroke or greater and moreover, the delivery pressure of the main hydraulic pump has increased to a high pressure equal to or higher than t he predetermined pressure. This makes it possible to constantly maintain with good accuracy the time point at which the second hydraulic cylinder is accelerated.

The present invention is also characterized in that in the above-described invention, the hydraulic drive system is provided with a control stroke detection means for detecting a control stroke of the second control device and a pump delivery pressure detection means for detecting the delivery pressure of the main hydraulic pump, and a controller for outputting a signal to operate the pressure oil feed means in accordance with the control stroke of the second control device as detected by the control stroke detection means and the delivery pressure of the main hydraulic pump as detected by the pump delivery pressure detection means.

According to the present invention constructed as described above, a signal is outputted from the controller to operate the pressure oil feed means when the control stroke detection means has detected a control of the second control device over the predetermined stroke or greater and the pump delivery pressure detection means has detected an increase of the delivery pressure of the main hydraulic pump to a high pressure equal to or higher than the predetermined pressure. As a consequence, the pressure oil feed means is operated to feed the hold-side pressure oil in the first hydraulic cylinder to the upstream side of the second directional control valve so that an acceleration of the second hydraulic cylinder can be performed.

The present invention is also characterized in that in the above-described invention, the hydraulic drive system is provided with a mode switch capable of selecting one of a mode, which enables an operation of the pressure oil feed means, and another mode, which disables an operation of the pressure oil feed means.

According to the present invention constructed as described above, changing-over of the mode switch makes it possible to selectively perform work, which requires an acceleration of the second hydraulic cylinder, and also work, which requires no acceleration of the second hydraulic cylinder, and therefore, the present invention has excellent working performance.

The present invention is also characterized in that in the above-described invention, the hydraulic drive system is provided with a main relief valve for controlling a maximum pressure of the hydraulic pump and an overload relief valve for controlling maximum pressures of the first hydraulic cylinder and second hydraulic cylinder, respectively, the overload relief valve being set at a preset pressure higher than the main relief valve, the pressure oil feed means is provided with a communication line for guiding the hold-side pressure oil in the first hydraulic cylinder to the upstream side of the second directional control valve, and a line is arranged to guide pressure oil in the communication line to the main relief valve.

According to the present invention constructed as described above, the hold-side pressure oil in the first hydraulic cylinder is fed to the upstream side of the second directional control valve via the communication line when the drive-side pressure of the second hydraulic cylinder has increased to a high pressure equal to or higher than the predetermined pressure, and at the same time, the pressure oil in the communication line is also guided to the main relief valve via the line. Accordingly, the pressure of the pressure oil to be guided from the first hydraulic cylinder to the upstream side of the second directional control valve is maintained lower than the preset pressure of the overload relief valve which controls the maximum pressure of the second hydraulic cylinder. This can realize the protection of the second hydraulic cylinder from the pressure of the pressure oil at the time of a combination of flows so that the durability of the second hydraulic cylinder can be secured.

The present invention is also characterized in that in the above-described invention, the hydraulic drive system is provided with a cancellation means for canceling an operation of the pressure oil feed means to prevent feeding the hold-side pressure oil in the first hydraulic cylinder to the upstream side of the second directional control valve when a control stroke of the first control device has exceeded a predetermined value.

Those work which desire to operate the first hydraulic cylinder substantially, for example, to a full stroke include those which require no acceleration of the second hydraulic cylinder. In the present invention, the cancellation means operates to cancel the operation of the pressure oil feed means when the control stroke of the first control device has exceeded the predetermined value with a view to substantially operating the second hydraulic cylinder. When the operation of the pressure oil feed means is cancelled as described above, the hold-side pressure oil in the first hydraulic cylinder is, therefore, not fed to the upstream side of the second directional control valve so that no acceleration of the second hydraulic cylinder is performed. In other words, when the first control device has been controlled substantially, the combination of the flow to the second hydraulic cylinder is cancelled so that in the course of work, the hydraulic drive system can also easily deal with cases where no combination of flow is needed.

The present invention is also characterized in that in the above-described invention, the hydraulic drive system is provided with a means for operating the pressure oil feed means when the first control device has been controlled over a predetermined stroke.

According to the present invention constructed as described above, an operation of the first hydraulic cylinder and an acceleration of the second hydraulic cylinder by the pressure oil feed means can be associated with each other. Described specifically, upon performing a combined operation of the first and second hydraulic cylinders, the oil pressure feed means can be operated in association with an operation of the first hydraulic cylinder to perform an acceleration of the second hydraulic cylinder.

The present invention is also characterized in that in the above-described invention, the hold-side pressure oil in the first hydraulic cylinder is selectively controlled by the first directional control valve to feed it to the upstream side of the second directional control valve.

According to the present invention constructed as described above, the first directional control valve is selectively controlled to have the flow combined to the upstream of the first directional control valve. Therefore, the hydraulic drive system is safe because, even in case that the pressure oil feed means that controls the combination of the flow fails with the pressure oil feed means maintained in a state communicated to the side of the second directional control valve, the first hydraulic cylinder operates only when the first control device is controlled.

The present invention is also characterized in that in the above-described invention, at least one of the two directional control valves which makeup the first directional control valve is provided with a passage to the pressure feed means which feeds the hold-side pressure oil in the first hydraulic cylinder to the upstream side of the second directional control valve and also with a passage which guides the hold-side pressure oil in the first hydraulic cylinder to a reservoir.

The present invention is also characterized in that in the above-described invention, the passage of the first directional control valve, which feeds the hold-side pressure oil in the first hydraulic cylinder to the upstream side of the second directional control valve, is fully opened from a state that the first control device has been controlled over at most a predetermined stroke.

According to the present invention constructed as described above, the hold-side pressure oil in the first hydraulic cylinder can be fed in its entirety to the upstream side of the second directional control valve from the time of a control of the first control device over at most the predetermined stroke.

The present invention is also characterized in that in the above-described invention, the passage of the first directional control valve, which feeds the hold-side pressure oil in the first hydraulic cylinder to the reservoir, begins to open from a state that the first control device has been controlled over at least a predetermined stroke.

According to the present invention constructed as described above, the first cylinder can be operated even when the pressure oil feed means that controls the combination of flow fails with the pressure oil feed means maintained in a state communicated to the second directional control valve, because the hold-side pressure oil in the first hydraulic cylinder can be drained to the reservoir when the first control device is controlled over at least the predetermined stroke.

The present invention is also characterized in that in the above-described invention, the first hydraulic cylinder comprises a boom cylinder and the second hydraulic cylinder comprises an arm cylinder.

In the present invention constructed as described above, an acceleration of the arm cylinder can be performed upon performing a combined operation of boom raising and arm crowding or a combined operation of boom raising and arm dumping.

According to the present invention constructed as described above, the hold-side pressure oil in the first hydraulic cylinder, said hold-side pressure oil having conventionally been drained to the reservoir when the drive-side pressure of the second hydraulic pressure has increased upon a combined operation of the first hydraulic cylinder and the second hydraulic cylinder, can be effectively used for the acceleration of the second hydraulic cylinder, thereby making it possible to realize an improvement in the efficiency of work which is performed through combined operations of these first hydraulic cylinder and second hydraulic cylinder.

DETAILED DESCRIPTION OF THE DRAWINGS

The embodiments of the hydraulic drive system according to the present invention will hereinafter be described based on the drawings.

Figure 1:
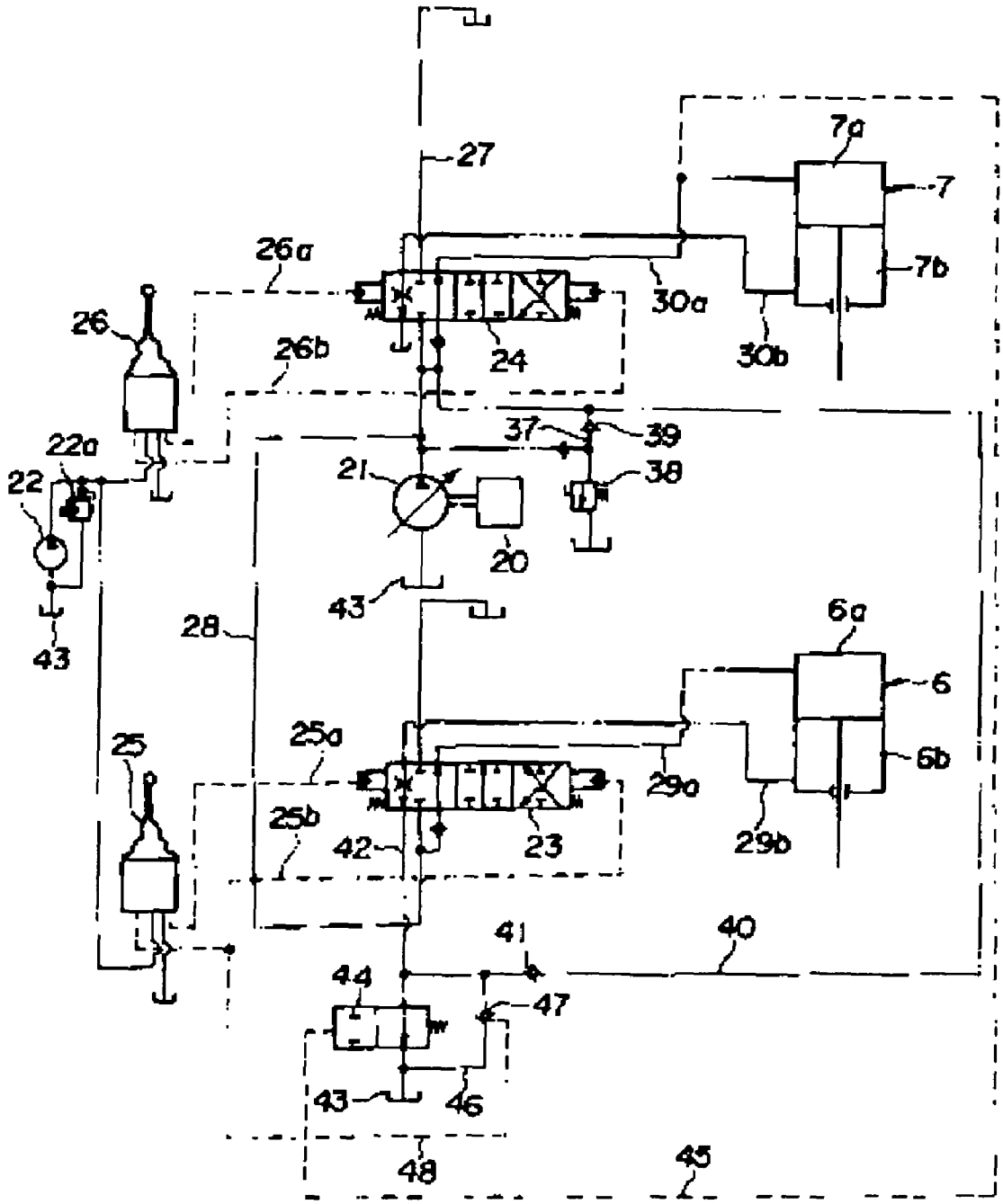
FIG. 1 is a hydraulic circuit diagram showing a first embodiment of the hydraulic drive system according to the present invention.

FIG. 1 is a hydraulic circuit diagram showing the first embodiment of the hydraulic drive system according to the present invention.

Figure 11:
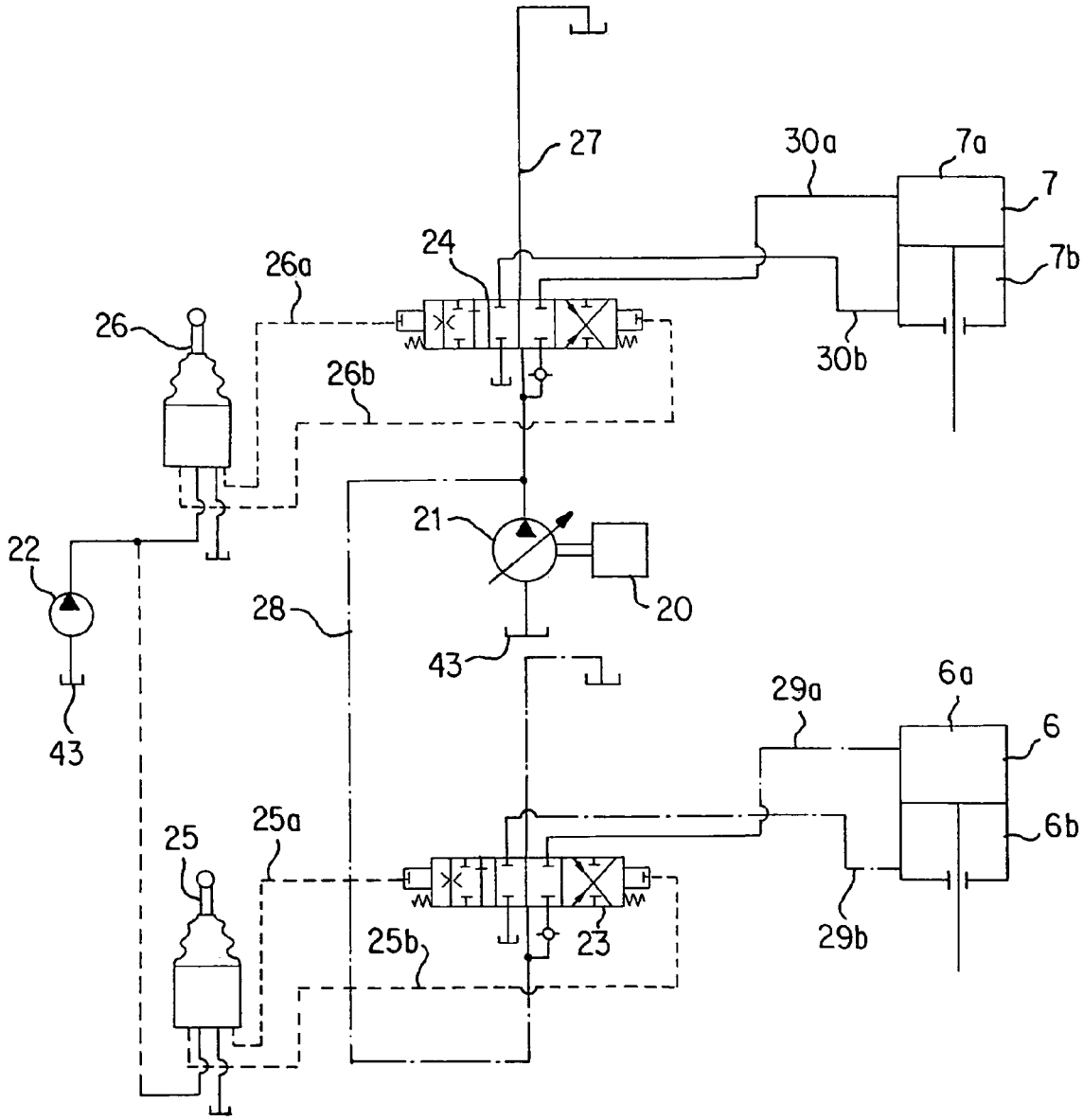
FIG. 11 PRIOR ART
FIG. 11 is a hydraulic circuit diagram showing a conventional hydraulic drive system.

In FIG. 1, elements equivalent to those shown in FIG. 11 described above are indicated by like reference numerals. Further, the first embodiment shown in FIG. 1 and the second to fourth embodiments to be described subsequently herein are also arranged on construction machines, for example, on the above-described hydraulic excavator illustrated in FIG. 12. The reference numerals shown in FIG. 12 will, therefore, be referred to in the subsequent description as needed.

The first embodiment shown in FIG. 1 also comprises a center-bypass hydraulic drive system for driving, for example, a boom cylinder 6 as a first hydraulic cylinder and an arm cylinder 7 as a second hydraulic cylinder. Although overlapping will occur with the description based on FIG. 11, the first embodiment shown in FIG. 1 is also constructed such that the boom cylinder 6 is provided with a bottom chamber 6*a* and a rod chamber 6*b* and the arm cylinder 7 is likewise provided with a bottom chamber 7*a* and a rod chamber 7*b*.

The first embodiment is also provided with an engine 20, a main hydraulic pump 21, a main relief valve 38 for controlling a maximum pressure of delivery pressure of the main hydraulic pump 21, a pilot pump 22 driven by the engine 20, a pilot relief valve 22*a* for controlling a maximum pressure of pilot pressure of the pilot pump 22, a first directional control valve for controlling a flow of pressure oil to be fed to the boom cylinder 6, i.e., a center-bypass-type directional control valve 23 for the boom, a second directional control valve for controlling a flow of pressure oil to be fed to the arm cylinder 7, i.e., a center-bypass-type directional control valve 24 for the arm. Also provided are a first control device for selectively controlling the directional control valve 23 for the boom, i.e., a boom control device 25 and a second control device for selectively controlling the directional control valve 24 for the arm, i.e., an arm control device 26.

Lines 27,28 are connected to a delivery line of the main hydraulic pump 21, the directional control valve 24 for the arm is arranged on the line 27, and the directional control valve 23 for the boom is arranged on the line 28.

The directional control valve 23 for the boom and the bottom chamber 6*a* of the boom cylinder 6 are connected via a main line 29*a*, while the directional control valve 23 for the boom and the rod chamber 6*b* of the boom cylinder 6 are connected via a main line 29*b*. The directional control valve 24 for the arm and the bottom chamber 7*a* of the arm cylinder 7 are connected via a main line 30*a*, while the directional control valve 24 for the arm and the rod chamber 7*b* of the arm cylinder 7 are connected via a main line 30*b*.

The boom control device 25 and arm control device 26 are composed, for example, of pilot control devices which produce pilot pressures, and are connected to a pilot pump 22.

Further, the boom control device 25 is connected to control chambers of the directional control valve 23 for the boom via pilot lines 25*a*,25*b*, respectively, while the arm control device 26 is connected to control chambers of the directional control valve 24 for the arm via pilot lines 26*a*,26*b*, respectively.

The above-described basic construction is substantially the same as the above-described construction illustrated in FIG. 11.

This first embodiment is provided with a pressure oil feed means for feeding the pressure oil in the rod chamber 6*b*, that is, the hold-side pressure oil in the boom cylinder 6, which makes up the first hydraulic cylinder, to the upstream side of the directional control valve 24 for the arm especially when the drive-side pressure, for example, the bottom pressure of the arm cylinder 7, which makes up the second hydraulic cylinder, has increased to a high pressure equal to or higher than a predetermined pressure.

As illustrated by way of example in FIG. 1, this pressure oil feed means includes a reservoir line 42 capable of communicating to the rod chamber 6*b* of the boom cylinder 6, a communication line 40 for communicating the reservoir line 42 and the upstream side of the directional control valve 24 for the arm with each other, a check valve 41 arranged on the communication line 40 to prevent a flow of pressure oil from the directional control valve 24 for the arm toward the directional control valve 23 for the boom, and a flow combiner valve 44 arranged on the reservoir line 42 to bring the reservoir line 42 into communication with the reservoir 43 when the bottom pressure of the arm cylinder 7 is lower than the predetermined pressure and to feed the pressure oil in the rod chamber 6*b* of the boom cylinder 6 to the upstream side of the directional control valve 24 for the arm via the reservoir line 42, which is cut off from the reservoir 43, and the communication line 40 when the bottom pressure increased to a pressure equal to or higher than the predetermined pressure. This flow combiner valve 44 is composed of a pilot-controlled selector valve which is changed over, for example, by a control pressure.

A control line 45 is arranged with an end thereof being in communication with the main line 30*a* extending to the bottom chamber 7*a* of the arm cylinder 7 and with an opposite end thereof being in communication with the control chamber of the flow combiner valve 44. It is designed to operate the flow combiner valve 44 responsive to a control pressure corresponding to the bottom pressure of the arm cylinder 7 as detected by the control line 45, in other words, to selectively control the flow combiner valve 44 to the right position as viewed in FIG. 1 against the force of the spring.

Also arranged are a line 46 connected at an end thereof to the part of the communication line 40 located on an upstream side of the check valve 41 and at an opposite end thereof to the reservoir 43, and a pilot-controlled check valve 47 arranged on the line 46 such that responsive to a predetermined control of the boom control device as the first control device, for example, an operation to feed pressure oil to the pilot line 25*b* to perform boom lowering, the line 46 is opened. The above-described pilot line 25*b* and pilot-controlled check valve 47 are connected together by a control line 48.

Further, the communication line 40 included in the above-mentioned pressure oil feed means is connected to the main relief valve 38 via a line 37. On the line 37 which guides the pressure oil in the communication line 40 to the main relief valve 38, a check valve 39 is arranged to prevent the pressure oil, which has been delivered from the main hydraulic pump 21, from flowing out to the communication line 40. It is to be noted that an overload relief valve for controlling the maximum pressure of the boom cylinder 6 and an overload relief valve for controlling the maximum pressure of the arm cylinder 7 are also arranged although they are not illustrated in the drawing. Preset pressures of these overload relief valves are set beforehand such that they become higher than a preset pressure of the main relief valve 38.

In the first embodiment constructed as described above, combined operations of the boom cylinder 6 and the arm cylinder 7 are performed as will be described hereinafter.

[Combined Operation of Boom Raising and Arm Crowding]

Figure 12:
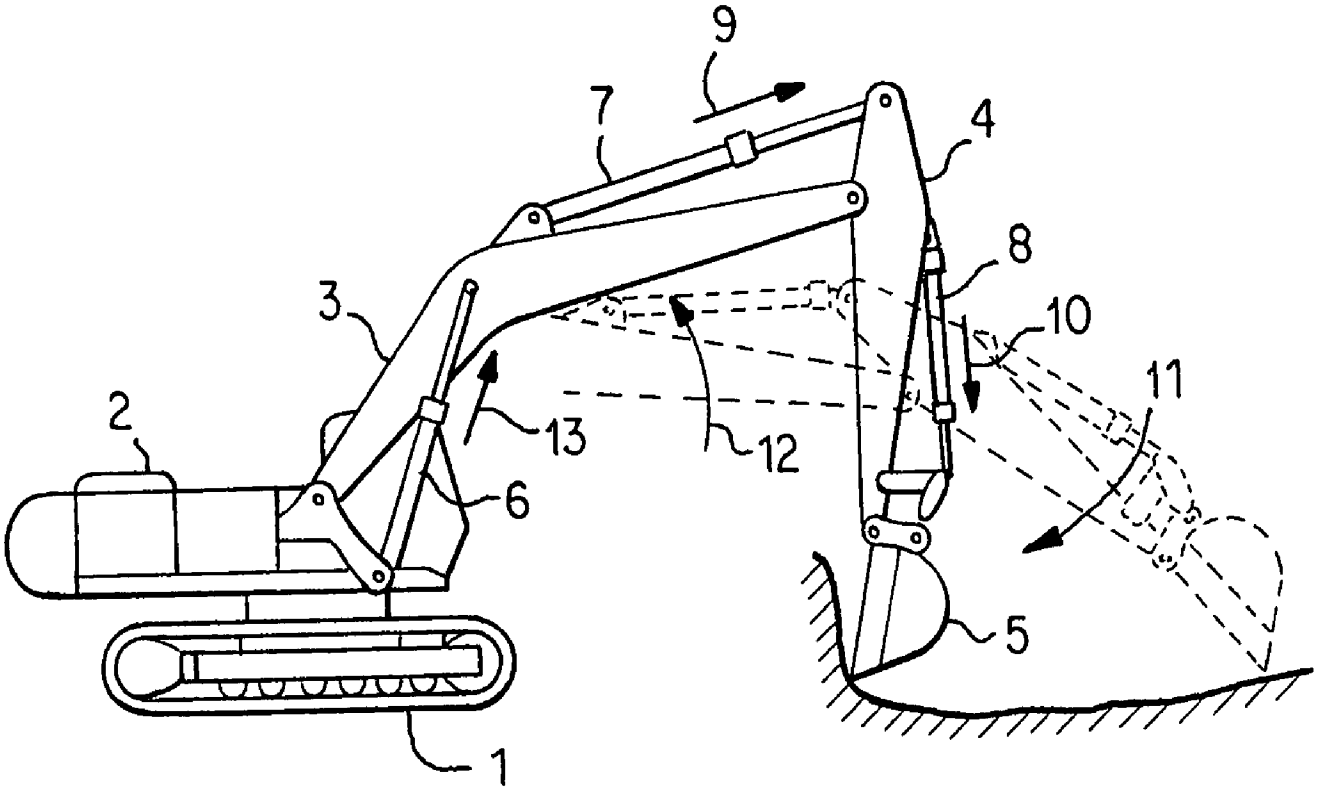
FIG. 12 PRIOR ART
FIG. 12 is a side view depicting a hydraulic excavator described as an example of a construction machine on which the hydraulic drive system shown in FIG. 11 is arranged.

When the boom control device 25 is controlled to feed a pilot pressure to the pilot line 25*a* such that the directional control valve 23 for the boom is changed over in to the left position as shown in FIG. 1 and further, the arm control device 26 is controlled to feed a pilot pressure to the pilot line 26*a* such that the directional control valve 24 for the arm is changed over into the left position as shown in FIG. 1, pressure oil delivered from the main hydraulic pump 21 is fed to the bottom chamber 6*a* of the boom cylinder 6via the line 28, the directional control valve 23 for the boom and the main line 29*a*, and further, the pressure oil delivered from the main hydraulic pump 21 is also fed to the bottom chamber 7*a* of the arm cylinder 7 via the line 27, the directional control valve 24 for the arm and the main line 30*a*. As a result, the boom cylinder 6 and arm cylinder 7 are both operated in extending directions so that as shown in FIG. 12, the boom 3 and arm 4 are caused to pivot in the directions of arrows 12 and 11, respectively, to perform a combined operation of boom raising and arm crowding.

During the above-described combined operation, the pilot line 25*b* of the boom operating system is not fed with the pilot pressure, and remains under the same pressure as the reservoir pressure. Therefore, the control line 48 takes the reservoir pressure so that the pilot-controlled check valve 47 remains in a closed position to prevent communication between the communication line 40 and the reservoir 43 via the line 46.

In a state that the bottom pressure of the arm cylinder 7 is lower than the predetermined pressure, on the other hand, the force of a control pressure applied to the control chamber of the flow combiner valve 44 via the control line 45 is smaller than the spring force, and therefore, the flow combiner valve 44 is held in the right position shown in FIG. 1. In this state, the rod chamber 6*b* of the boom cylinder 6 is in communication with the reservoir 43 via the main line 29*b*, the directional control valve 23 for the boom, the reservoir line 42, and the flow combiner valve 44. During an extending operation of the boom cylinder 6, the pressure oil in the rod chamber 6*b* of the boom cylinder 6 is, therefore, returned to the reservoir 43, and the pressure oil in the rod chamber 6*b* is not fed to the upstream side of the directional control valve 24 for the arm via the communication line 40.

When the bottom pressure of the arm cylinder 7 rises to a high pressure equal to or higher than the predetermined pressure from such a state as described above, the force of a control pressure applied to the control chamber of the flow combiner valve 44 via the control line 45 becomes greater than the spring force so that the flow combiner valve 44 is changed over into the left position in FIG. 1. When this state is established, the reservoir line 42 is cut off by the flow combiner valve 44 so that the pressure oil, which has been guided from the rod chamber 6*b* of the boom cylinder 6 into the main line 29*b*, the directional control valve 23 for the boom and the reservoir line 42, is fed to the communication line 40 via the check valve 41.

The pressure oil fed to the communication line 40 is fed to the upstream side of the directional control valve 24 for the arm. Described specifically, the pressure oil delivered from the main hydraulic pump 21 and the pressure oil from the rod chamber 6*b* of the boom cylinder 6 as fed via the communication line are combined and fed to the directional control valve 24 for the arm, and the thus-combined pressure oil is fed to the bottom chamber 7*a* of the arm cylinder 7 via the main line 30*a*. is fed to the bottom chamber 7*a* of the arm cylinder 7 via the main line 30*a*. As a result, an acceleration of arm cylinder 6 in the extending direction can be realized. In other words, the operating speed of arm crowding can be rendered faster.

Figure 2:
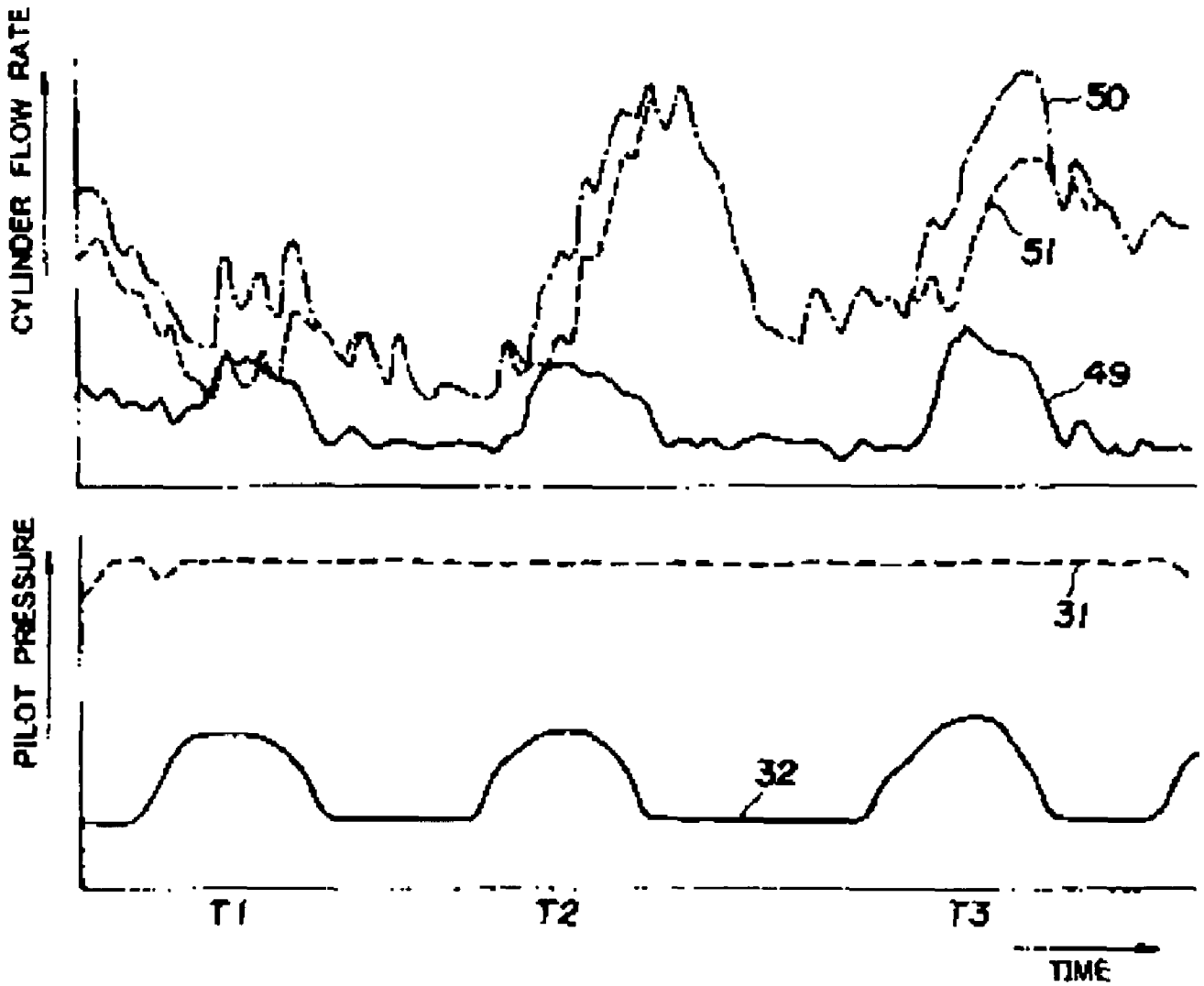
FIG. 2 contains characteristic diagrams illustrating pilot pressure characteristics and cylinder flow-rate characteristics in the first embodiment shown in FIG. 1.

FIG. 2 contains characteristic diagrams showing pilot pressure characteristics and cylinder flow-rate characteristics in the first embodiment illustrated in FIG. 1.

Figure 13:
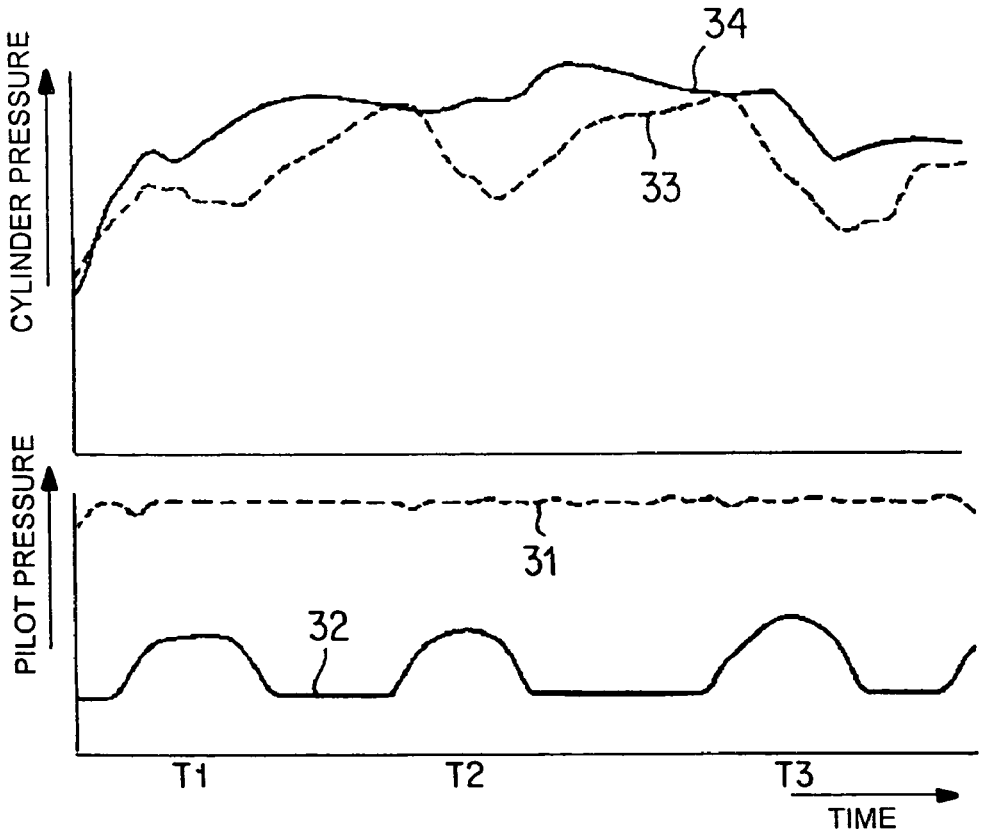
FIG. 13 PRIOR ART
FIG. 13 contains characteristic diagrams illustrating pilot pressure characteristics and cylinder pressure characteristics in the conventional hydraulic drive system.

In FIG. 2, the lower diagram is similar to that shown in FIG. 13 described above. In the upper diagram, numeral 49 indicates a rod flow rate of the boom cylinder, numeral 50 designates a bottom flow rate of the arm cylinder, and numeral 51 represents a bottom rate of the arm cylinder in the above-described conventional art illustrated in FIGS. 11 to 13. As evident from FIG. 2, compared with the conventional art, the first embodiment can increase the bottom flow rate of the arm cylinder, and as mentioned above, can realize an acceleration in arm crowding.

[Combined Operation of Boom Lowering and Arm Crowding]

When the boom control device 25 is controlled to feed a pilot pressure to the pilot line 25*b* such that the directional control valve 23 for the boom is changed over into the right position shown in FIG. 1 and further, the arm control device 26 is controlled to feed a pilot pressure to the pilot line 26*a* such that the directional control valve 24 for the arm is changed over into the left position, pressure oil delivered from the main hydraulic pump 21 is fed to the rod chamber 6*b* of the boom cylinder 6 via the line 28, the directional control valve 23 for the boom and the main line 29*b*, and as mentioned above, the pressure oil delivered from the main hydraulic pump 21 is also fed to the bottom chamber 7*a* of the arm cylinder 7 via the line 27, the directional control valve 24 for the arm and the main line 30*a*. As a result, the boom cylinder 6 is operated in a retracting direction and the arm cylinder 7 is operated in the extending direction, so that the boom 3 is caused to pivot in a lowering direction opposite to arrow 12 in FIG. 12 and the arm 4 is caused to pivot in the direction of arrow 11. A combined operation of boom lowering and arm crowding is performed, accordingly.

As the pilot pressure is being fed to the pilot line 25*b* in the boom operating system during such a combined operation, a control pressure is guided into the control line 48 so that the pilot-controlled check valve 47 is operated to open the line 46. As a result, the part of the communication line 40 on the upstream side of the flow combiner valve 44 is brought into communication with the reservoir 43.

When the bottom pressure of the arm cylinder 7 rises to a high pressure equal to or higher than the predetermined pressure, the flow combiner valve 44 is changed over into the left position in FIG. 1 as mentioned above. The part of the communication line 40 is, however, in communication with the reservoir 43 via the pilot-controlled check valve 47 and the line 46 as mentioned above. Consequently, the bottom chamber 6*a* of the boom cylinder 6 is brought into a state communicated with the reservoir 43.

In this state, the pressure oil in the bottom chamber 6*a* of the boom cylinder 6 is returned to the reservoir 43 via the main line 29*a*, the directional control valve 23 for the boom, the reservoir 42 and the line 46. No pressure oil is, therefore, fed to the upstream side of the directional control valve 24 for the arm so that no acceleration is performed in arm crowding.

In this first embodiment, upon performing a combined operation including arm dumping in which pressure oil is fed to the rod chamber 7*b* of the arm cylinder 7, the bottom chamber 7*a* of the arm cylinder 7 is brought into communication with the reservoir 43. No pressure is, therefore, developed in the control line 45 so that no acceleration of the arm cylinder 7 is performed.

In the first embodiment constructed as described above, during a combined operation of boom raising and arm crowding performed frequently during digging work or the like of earth, the pressure oil in the rod chamber 6*a* of the boom cylinder 6, said pressure oil having been compressed to a high pressure by digging counterforce, can be combined to the bottom chamber 7*a* of the arm cylinder 7. This makes it possible to effectively use the pressure oil in the rod chamber 6*a* of the boom cylinder 6, said pressure oil having heretofore been simply drained into the reservoir 43, for the acceleration of the arm cylinder 7 and hence, to achieve an improvement in the efficiency of the work.

Even when the bottom pressure of the arm cylinder 7 is a high pressure equal to or higher than the predetermined pressure, an acceleration of the arm cylinder 7, in other words, an acceleration of the operating speed of arm crowding can be reduced by opening the pilot-controlled check valve 47 when boom lowering which requires retraction of the boom cylinder 6 is performed. It is, therefore, possible to continue the desired working performance by combined operations of boom lowering and arm crowding.

In the above-described first embodiment, when the bottom pressure of the arm cylinder 7 has increased to a high pressure equal to or higher than the predetermined pressure upon performing a combined operation of boom raising and arm crowding, the pressure oil in the rod chamber 6*b* of the boom cylinder 6 is fed to the upstream side of the directional control valve 24 for the arm via the communication line 40 as mentioned above. At this time, the pressure oil in the communication line 40 is guided to the main relief valve 38 via the check valve 39. The pressure of the pressure oil guided from the boom cylinder 6 to the upstream side of the directional control valve 24 for the arm is, therefore, maintained lower than the preset pressure of an unillustrated overload relief valve which controls the maximum pressure of the arm cylinder 7. As a consequence, it is possible to realize the protection of the arm cylinder 7 from the pressure of pressure oil at the time of the above-mentioned combination of flows. Accordingly, the durability of the arm cylinder 7 can be secured.

In the above-described first embodiment, upon performing a combined operation of boom raising and arm crowding, an acceleration of the arm cylinder 7 is realized by arranging the control line 45 that communicates the main line 30*a*, which extends to the bottom chamber 7*a* of the arm cylinder 7, and the control chamber of the flow combiner valve 44 with each other. The present invention is, however, not limited to such realization of an acceleration of the arm cylinder 7 upon performing a combined operation of boom raising and arm crowding. Described specifically, it is possible, for example, to construct such that another control line is arranged to communicate the main line 30*b*, which extends to the rod chamber 7*b* of the arm cylinder 7, and the control chamber of the flow combiner valve 44 with each other and hence, to realize an acceleration of the arm cylinder 7 upon performing a combined operation of boom raising and arm dumping. When constructed as described above, the hydraulic drive system is suited for the work shown in FIG. 12 that earth is pushed by the bucket 5, and can realize an improvement in the efficiency of the work.

Figure 3:
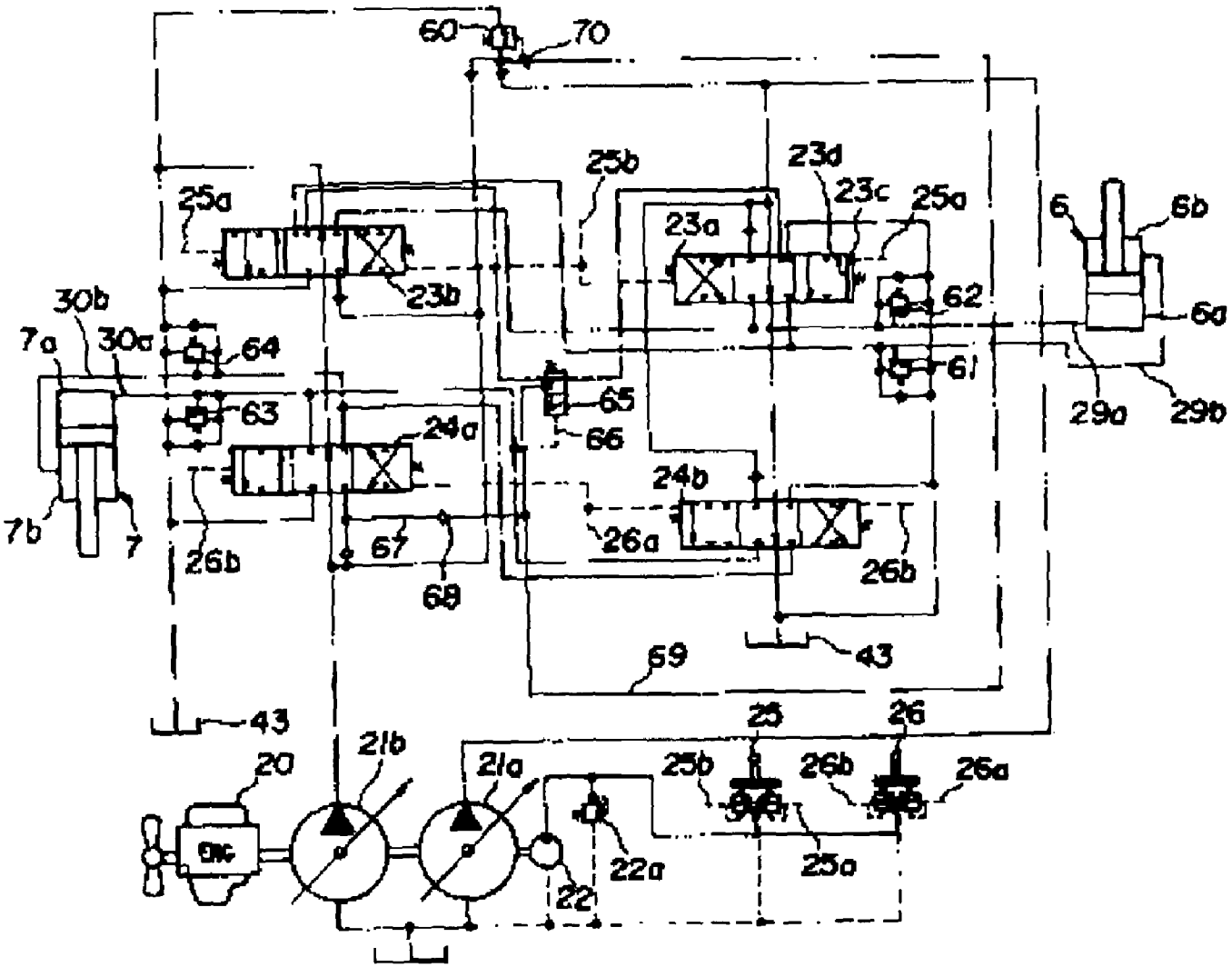
FIG. 3 is a hydraulic circuit diagram showing a second embodiment of the present invention.
Figure 4:
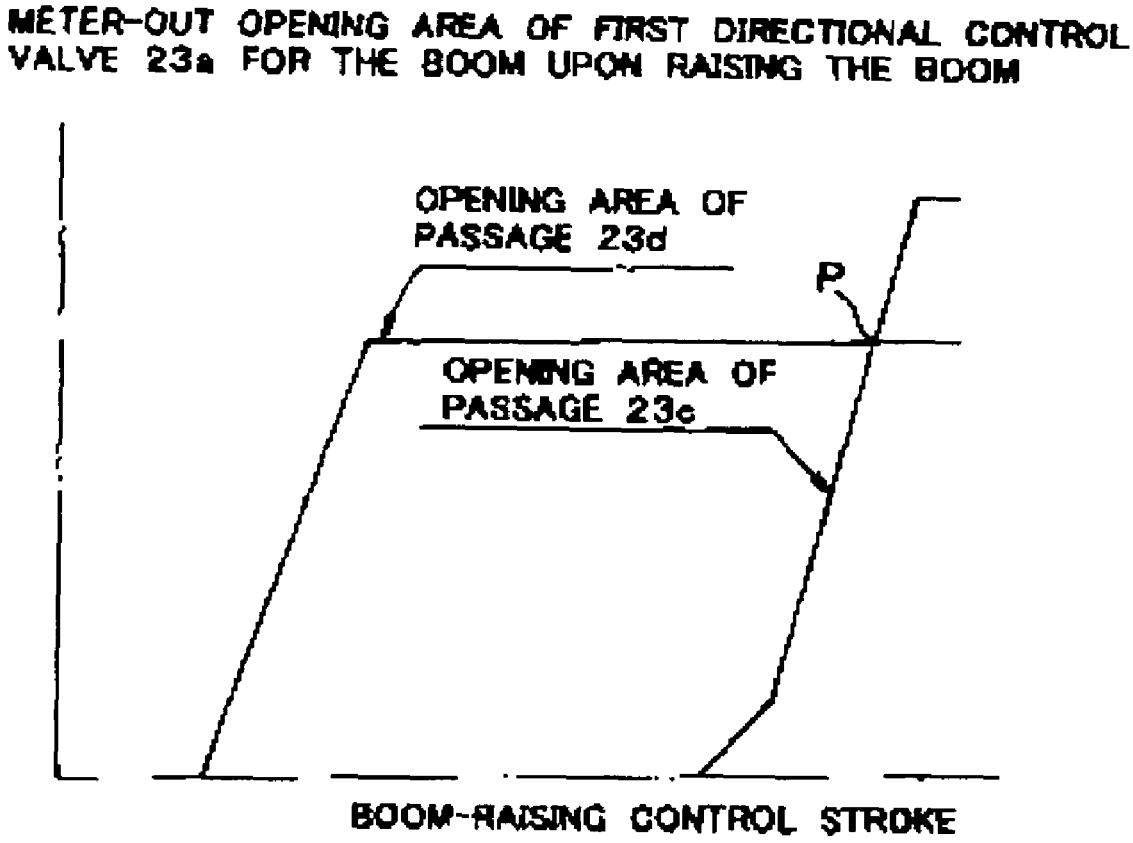
FIG. 4 is a characteristic diagram showing meter-out opening area characteristics of a first directional control valve for a boom, said first directional control valve being arranged in the second embodiment depicted in FIG. 3, upon raising the boom.
Figure 5:
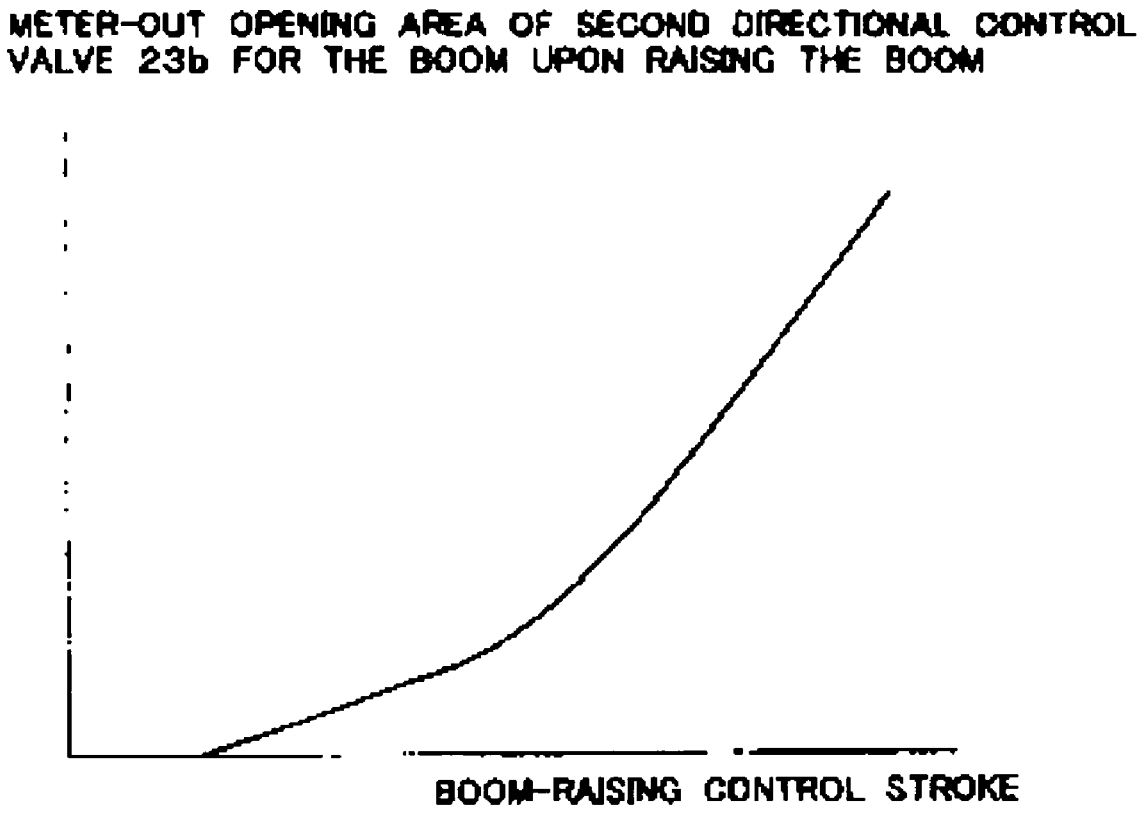
FIG. 5 is a characteristic diagram showing meter-out opening area characteristics of a second directional control valve for the boom, said second directional control valve being arranged in the second embodiment depicted in FIG. 3, upon raising the boom.
Figure 6:
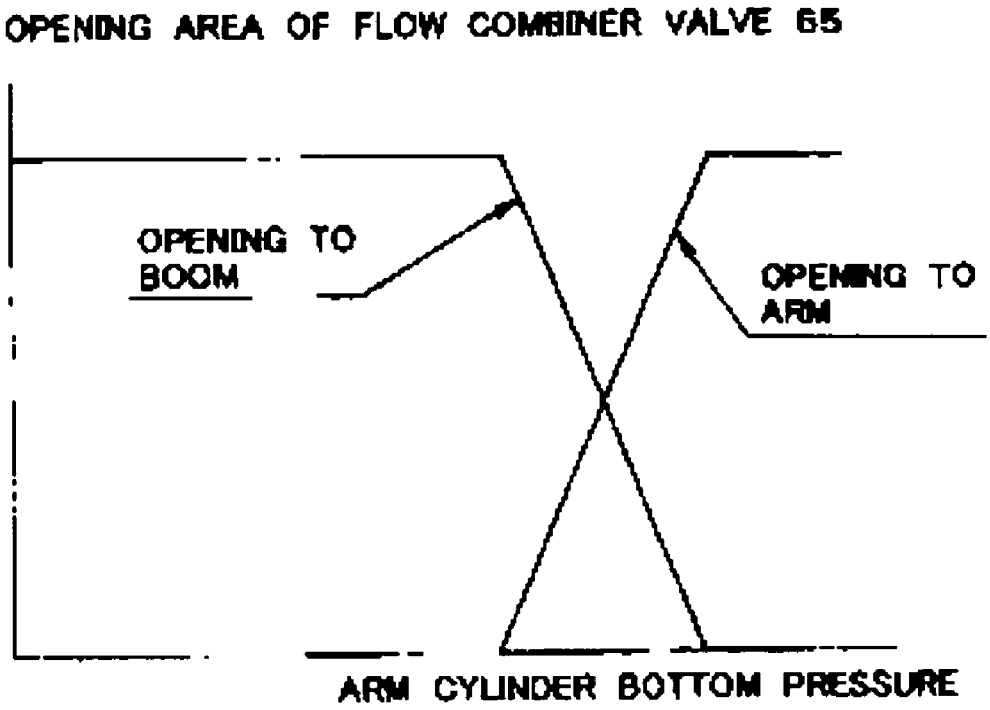
FIG. 6 is a characteristic diagram illustrating opening area characteristics of a flow combiner valve arranged in the second embodiment depicted in FIG. 3.

FIG. 3 is a hydraulic circuit diagram showing a second embodiment of the present invention, FIG. 4 is a characteristic diagram showing meter-out opening area characteristics of a first directional control valve 23*a* for the boom, said first directional control valve being arranged in the second embodiment depicted in FIG. 3, upon raising the boom, FIG. 5 is a characteristic diagram showing meter-out opening area characteristics of a second directional control valve 23*b* for the boom, said second directional control valve being arranged in the second embodiment depicted in FIG. 3, upon raising the boom, and FIG. 6 is a characteristic diagram illustrating opening area characteristics of a flow combiner valve 65 arranged in the second embodiment depicted in FIG. 3.

In the second embodiment depicted in FIG. 3, the main hydraulic pump driven by the engine 20 is composed of a first pump 21*a* and a second pump 21*b*. The first pump 21*a* can feed pressure oil to the first hydraulic cylinder, i.e., the boom cylinder 6 and the second hydraulic cylinder, i.e., the arm cylinder 7, respectively, while the second pump 21*b* can feed pressure oil to the boom cylinder 6 and the arm cylinder 7, respectively.

The first directional control valve for controlling the flow of pressure oil to be fed to the boom cylinder 6, that is, the directional control valve for the boom is composed of two directional control valves consisting of the first directional control valve 23*a* for the boom, which is interposed between the first pump 21*a* and the boom cylinder 6, and the second directional control valve 23*b* for the boom, which is interposed between the second pump 21*b* and the boom cylinder 6.

Similarly, the second directional control valve for controlling the flow of pressure oil to be fed to the arm cylinder 7, that is, the directional control valve for the arm is also composed of two directional control valves consisting of a first directional control valve 24*a* for the arm, which is interposed between the second pump 21*b* and the arm cylinder 7, and a second directional control valve 24*b* for the arm, which is interposed between the first pump 21*a* and the arm cylinder 7.

At a right position of the first directional control valve 23*a* for the boom as viewed in FIG. 3, said first directional control valve being changed over by a pilot pressure upon boom raising, namely, a pilot pressure guided through the pilot line 25*a*, a passage 23*c* and passage 23*d* are arranged. The passage 23*c* can be brought into communication with the reservoir 43, while the passage 23*d* branches out from the passage 23*c* and can be brought into communication with the communication line 67 connected to the upstream side of the first directional control valve 24*a* for the arm.

For example, the above-mentioned passage 23*d* is set such that as illustrated in FIG. 4, it is opened from the time that the boom-raising control stroke, which is a control stroke of the boom control device 25, is relatively small, its opening area becomes gradually greater as the boom-raising control stroke increases, and thereafter, a constant opening area is maintained. On the other hand, the passage 23*c* which can be connected to the reservoir 43 is set, for example, such that it is opened when the boom-raising control stroke has become relatively large, its opening area becomes gradually greater as the boom-raising control stroke increases, and thereafter, a constant opening area is maintained.

While the control stroke of the boom-raising control device 25 is relative small, in other words, while it is controlled in a precision mode, the passage 23*c* is, therefore, maintained in the closed state although the passage 23*d* is brought into communication with the communication line 67 shown in FIG. 3. When the boom-raising control device 25 is controlled, for example, to the maximum, the passage 23*c* is opened so that the pressure oil is returned to the reservoir 43 via the passage 23*c*.

The second directional control valve for the boom, on the other hand, is set such that as illustrated in FIG. 5, it is opened from the time that the boom-raising control stroke is relatively small and its meter-out opening area becomes gradually greater as the boom-raising control stroke increases.

On the above-mentioned communication line 67, there is arranged the flow combiner valve 65 which is changed over depending on the magnitude of a load pressure applied to the bottom chamber 7*a* of the arm cylinder 7. The pressure of the bottom chamber 7*a* of the arm cylinder 7 is applied to the control chamber of the flow combiner valve 65 via a control line 66.

The opening area of the flow combiner valve 65 is set as shown in FIG. 6. Described specifically, the flow combiner valve 65 is set such that, while the pressure of the bottom chamber 7*a* of the arm cylinder 7, said pressure being applied via the control line 66, is relatively small, the flow combiner valve 65 is held in the upper changed-over position as viewed in FIG. 3 by the spring force, its opening area to the line via which it is connected to the second directional control valve 23*b* for the boom becomes the maximum, and its opening area to the communication line 67 via which it is connected to the first directional control valve 24*a* for the arm becomes zero (0).

The flow combiner valve 65 is also set such that, when the pressure of the bottom chamber 7*a* of the arm cylinder 7 gradually increases and the flow combiner valve 65 begins to move against the spring force, its opening area to the communication line 67 gradually increases while its opening area to the line via which it is connected to the second directional control valve 23*b* for the boom becomes gradually small.

The flow combiner valve 65 is also set such that, when the pressure of the bottom chamber 7*a* of the arm cylinder 7 has increased to a high pressure equal to or higher than the predetermined pressure, its opening area to the line via which it is connected to the second directional control valve 23*b* for the boom becomes zero (0) while its opening area to the communication line 67 becomes the maximum.

It is to be noted that as illustrated in FIG. 3, a check valve 68 is arranged on the communication line 67 to prevent the pressure oil, which is delivered from the second pump 21*b*, from flowing out toward the flow combiner valve 65.

The passage 23*d* arranged at the right position of the first directional control valve 23*a* as viewed in FIG. 3, the communication line 67, the flow combiner vale 65, the control line 66 and the check valve 78 constitute a pressure oil feed means which feeds the hold-side pressure oil in the first hydraulic cylinder, i.e., the boom cylinder 6, that is, the pressure oil in the rod chamber 6*b* to the upstream side of the first directional control valve 24*a* for the arm when the drive-side pressure of the second hydraulic cylinder, i.e., the arm cylinder 7, for example, the bottom pressure of the arm cylinder 6 has increased to a high pressure equal to or higher than the predetermined pressure.

Further, a correlation in opening between the passage 23*c* and the passage 23*d* arranged at the right position of the first directional control valve 23*a* for the boom is set such that as shown in FIG. 4 described above, a point P of intersection between a characteristic line of the opening area of the passage 23*c* and a characteristic line of the opening area of the passage 23*d* is chosen as a predetermined value and, when a boom-raising control stroke increases beyond the predetermined value, the amount of pressure oil in the rod chamber 6*b* of the boom cylinder 6, said pressure oil being to be returned to the reservoir 43 via the passage 23*c*, becomes greater. Accordingly, these passage 23*c* and passage 23*d* constitute a cancellation means which cancels the above-mentioned operation of the pressure oil feed means to avoid feeding of the hold-side pressure oil in the boom cylinder 6, that is, the pressure oil in the rod chamber 6*b* to the upstream side of the first directional control valve 23*a* for the arm when the control stroke of the boom control device 25 has exceeded the point Pin FIG. 4, that is, the predetermined value.

The passage 23*d*, which can be brought into communication with the communication line 67 when the first directional control valve 23*a* for the boom has been changed over the predetermined stroke, constitutes a means for operating the above-mentioned pressure oil feed means when the boom control device 25 is controlled over the predetermined stroke.

As shown in FIG. 3, this second embodiment is provided with overload relief valves 61, 62 and overload relief valves 63, 64. The overload relief valves 61, 62 control the maximum pressure of the boom cylinder 6 and are set at a pressure higher than a main relief valve 60, while the overload relief valves 63, 64 control the maximum pressure of the arm cylinder 7 and are set at a pressure higher than the main relief valve 60. Also arranged are a line 69, which connects the communication line 67 and the main relief valve 60 with each other, and a check valve 70 which prevents the pressure oil, which is delivered from the second pump 21*b*, from flowing out toward the communication line 67.

The second embodiment constructed as described above operates as will be described hereinafter.

[Single Operation of Boom Raising]

When a pilot pressure is produced in the pilot line 25*a* by controlling the boom control device 25, for example, with a view to performing a single operation of boom raising, the first directional control valve 23*a* for the boom is changed over into the right position as viewed in FIG. 3 while the second directional control valve 23*b* for the boom is changed over into the right position as viewed in FIG. 3. As a result, the pressure oil in the first pump 21*a* is fed to the bottom chamber 6*a* of the boom cylinder 6 via the first directional control valve 23*a* for the boom and the main line 29*a*, and the pressure oil in the second pump 21*b* is fed to the bottom chamber 6*a* of the boom cylinder 6 via the second directional control valve 23*b* for the boom and the main line 29*a*. Namely, the pressure oils from the first pump 21*a* and second pump 21*b* are combined and fed to the bottom chamber 6*a* of the boom cylinder 6. Further, the pressure oil in the rod chamber 6*b* of the boom cylinder 6 flows out to the main line 29*b*.

When the control stroke of the boom control device 25 is relatively small at this time, the passage 23*c* is maintained in a closed state although the passage 23*d* is slightly opened or is opened to give a constant opening area, as indicated by the opening area characteristics of the passage 23*d* and the opening area characteristics of the passage 23*c* in FIG. 4. The pressure oil in the rod chamber 6*b* of the boom cylinder 6, which has flowed out to the main line 29*a*, is guided to the second directional control valve 23*b* for the boom via the passage 23*d* of the first directional control valve 23*a* for the boom and the flow combiner valve 65 held in the upper position illustrated in FIG. 3, and via the second directional control valve 23*b* for the boom, is then returned to the reservoir 43. A relatively small amount of the pressure oil, which is dependent on the opening area of the passage 23*d* as shown in FIG. 4 and the meter-out characteristics of the second directional control valve 23*b* for the boom upon boom raising as shown in FIG. 5, is returned to the reservoir 43, there by making it possible to perform a precise boom-raising operation.

When the control stroke of the boom control device 25 is large upon performing the single boom-raising operation, the main line 29*b* is brought into communication with the reservoir 43 via the passage 23*c* as indicated by the opening characteristics of the passage 23*c* in FIG. 4. The pressure oil in the rod chamber 6*b* of the boom cylinder 6 is, therefore, returned from the main line 29*b* to the reservoir 43 via the passage 23*c* of the first directional control valve 23*a* for the boom and the second directional control valve 23*b* for the boom. It is, therefore, possible to perform boom raising promptly.

When the boom control device 25 is controlled with a view to performing a single boom-lowering operation, the first directional control valve 23*a* for the boom and the second directional control valve 23*b* for the boom are changed over into the left position and the right position, respectively, by a pilot pressure guided via the pilot line 25*b*, so that the pressure oil from the first pump 21*a* is fed to the main line 29*b* via the first directional control valve 23*a* for the boom and the pressure oil from the second pump 21*b* is fed to the main line 29*b* via the second directional control valve 23*b* for the boom. In other words, the pressure oils from the first pump 21*a* and second pump 21*b* are combined and fed to the rod chamber 6*b* of the boom cylinder 6via the main line 29*b*, and the pressure oil in the bottom chamber 6*a* is returned to the reservoir 43 via the first directional control valve 23*a* for the boom and the second directional control valve 23*b* for the boom. As a consequence, boom lowering can be performed.

[Single Operations of Arm]

When the arm control device 26 is controlled with a view to performing a single arm-crowding operation, for example, the first directional control valve 24*a* for the arm and the second directional control valve 24*b* for the arm are changed over into the right position and the left position, respectively, by a pilot pressure guided via the pilot line 26*a*, so that the pressure oil from the first pump 21*b* is fed to the main line 30*a* via the first directional control valve 24*a* for the arm and the pressure oil from the first pump 21*a* is fed to the main line 30*a* via the second directional control valve 24*b* for the arm. In other words, the pressure oils from the first pump 21*a* and second pump 21*b* are combined and fed to the bottom chamber 7*a* of the arm cylinder 7 via the main line 30*a*, and the pressure oil in the bottom chamber 7*b* is returned to the reservoir 43 via the first directional control valve 24*a* for the arm. As a consequence, arm crowding can be performed.

When the arm control device 26 is controlled with a view to performing a single arm-dumping operation, on the other hand, the first directional control valve 24*a* for the arm and the second directional control valve 24*b* for the arm are changed over into the left position and the right position, respectively, by a pilot pressure guided via the pilot line 26*b*, so that the pressure oil from the first pump 21*b* is fed to the main line 30*b* via the first directional control valve 24*a* for the arm and the pressure oil from the first pump 21*a* is fed to the main line 30*b* via the second directional control valve 24*b* for the arm. In other words, the pressure oils from the first pump 21*a* and second pump 21*b* are combined and fed to the rod chamber 7*b* of the arm cylinder 7 via the main line 30*b*, and the pressure oil in the bottom chamber 7*a* is returned to the reservoir 43 via the first directional control valve 24*a* for the arm and the second directional control valve 24*b* for the arm. As a consequence, arm dumping can be performed.

[Combined Operation of Boom Raising and Arm Crowding]

Upon performing a combined operation of boom raising and arm crowding, for example, the boom control device 25 is controlled to change over the first directional control valve 23*a* for the boom and the second directional control valve 23*b* for the boom into the right position and the left position, respectively, and the arm control device 26 is controlled to change over the first directional control valve 24*a* for the arm and the second directional control valve 24*b* for the arm into the right position and the left position, respectively.

As a result, the pressure oil from the first pump 21*a* and the pressure oil from the second pump 21*b* are fed to the main line 29*a* via the first directional control valve 23*a* for the boom and the second directional control valve 23*b* for the boom, respectively, and are then fed to the bottom chamber 6*a* of the boom cylinder 6. The pressure oil in the rod chamber 6*b* of the boom cylinder 6 flows out to the main line 29*b*.

Further, the pressure oil from the second pump 21*b* and the pressure oil from the first pump 21*a* are fed to the main line 30*a* via the first directional control valve 24*a* for the arm and the second directional control valve 24*b* for the arm, respectively, and are then fed to the bottom chamber 7*a* of the arm cylinder 7. The pressure oil in the rod chamber 7*b* of the arm cylinder 7 is returned to the reservoir 43 via the main line 30*b* and the first directional control valve 24*a* for the arm. As a consequence, arm crowding can be performed.

It is to be noted that in the above-mentioned combined operation of boom raising and arm crowding, the flow combiner valve 65 is held in the upper position shown in FIG. 3 when the pressure in the bottom chamber 7*a* is lower than the predetermined pressure. In this case, when the control stroke of the boom control device 25 is relatively small, the passage 23*c* of the first directional control valve 23*a* for the boom is closed although the passage 23*d* is opened, as mentioned above. Therefore, the pressure oil in the main line 29*b* is guided to the second directional control valve 23*b* for the boom via the passage 23*d* of the first directional control valve 23*a* for the boom and the flow combiner valve 65 held in the upper position shown in FIG. 3, and from the second directional control valve 23*b* for the boom, is then returned to the tank 43. As a result, a precise boom-raising operation or the like can be performed. Namely, a combined operation of boom raising and arm crowding, including a precise operation, can be performed.

When the bottom pressure in the bottom chamber 7*a* of the arm cylinder 7 has increased to the predetermined pressure or higher in the above-mentioned combined operation of boom raising and arm crowding, the pressure in this bottom chamber 7*a* is fed to the control chamber of the flow combiner valve 65 via the control line 66 so that the flow combiner valve 65 is changed over into the lower position against the spring force. When the control stroke of the boom control device 25 is relatively small in this case, in other words, when the passage 23*d* shown in FIG. 3 opens but the passage 23*c* also depicted in FIG. 3 is so small that it does not open, the pressure oil in the rod chamber 6*b* of the boom cylinder 6, said pressure oil having been guided to the main line 29*b*, is fed to the upstream side of the first directional control valve 24*a* for the arm via the passage 23*d* of the first directional control valve 23*a* for the boom, the flow combiner valve 65 changed over into the lower position, the communication line 67 and the check valve 68. In other words, the pressure oil in the rod chamber 6*b* of the boom cylinder 6 and the pressure oil from the second pump 21*b* are combined and fed to the first directional control valve 24*a* for the arm, and are then fed to the bottom chamber 7*a* of the arm cylinder 7. As a result, the arm cylinder 7 is accelerated so that arm crowding can be performed at a high speed. Namely, a combined operation of boom raising and accelerated arm crowding can be performed.

When the control stroke of the boom control device 25 is large, for example, in the above-mentioned combined operation of boom raising and arm crowding, the passage 23*c* of the first directional control valve 23*a* for the boom is brought into communication with the reservoir 43 as mentioned above. Even if, as mentioned above, the flow combiner valve 65 has been changed over into the lower position and the passage 23*d* of the first directional control valve 23*a* for the boom and the communication line 67 are in a communicated state, the pressure oil flowed out to the main line 29*b* from the rod chamber 6*b* of the boom cylinder 6 is returned to the reservoir 43 via the passage 23*c* of the first directional control valve 23*a* for the boom. Namely, a combined operation of boom raising and arm crowding can be performed including an operation of the arm cylinder 7 only by the pressure oils from the first and second pumps 21*a*,21*b*.

[Combined Operation of Boom Raising and Arm Dumping]

The boom control device 25 and arm control device 26 are controlled to change over the first directional control valve 23*a* for the boom and the second directional control valve 23*b* for the boom into the right position and left position, respectively, and also to change over the first directional control valve 24*a* for the arm and the second directional control valve 24*b* for the arm into the left position and right position, respectively.

At this time, the bottom chamber 7*a* of the arm cylinder 7 is brought into communication with the reservoir 43 via the first directional control valve 24*a* for the arm and the second directional control valve 24*b* for the arm. As a result, the pressure which is guided to the control line 66 is low in pressure so that the flow combiner valve 65 is held in the upper position shown in FIG. 3.

The pressure oils from the first pump 21*a* and second pump 21*b* are, therefore, guided to the bottom chamber 6*a* of the boom cylinder 6 via the first directional control valve 23*a* for the boom and the second directional control valve 23*b* for the boom. Depending on the control stroke of the boom control device 25, the pressure oil in the rod chamber 6*b* is returned from the passage 23*d* of the first directional control valve 23*a* for the boom to the reservoir 43 via the flow combiner valve 65, which is held in the upper position, and the second directional control valve 23*b* for the boom, or via the passage 23*c* of the first directional control valve 23*a* for the boom and also via the passage 23*d* of the first directional control valve 23*a* for the boom, the flow combiner valve 65 held in the upper position and the second directional control valve 23*b* for the boom. As a consequence, boom raising can be performed.

Further, the pressure oils from the second pump 21*b* and first pump 21*a* are fed to the rod chamber 7*b* of the arm cylinder 7 via the first directional control valve 24*a* for the arm and the second directional control valve 24*b* for the arm, while the pressure oil in the bottom chamber 7*a* of the arm cylinder 7 is returned to the reservoir 43 via the first directional control valve 24*a* for the arm and the second directional control valve 24*b* for the arm. As a consequence, arm dumping can be performed. Namely, a combined operation of boom raising and arm dumping can be performed.

[Combined Operation of Boom Lowering and Arm Crowding]

The boom control device 25 and arm control device 26 are controlled to change over the first directional control valve 23*a* for the boom and the second directional control valve 23*b* for the boom into the left position and right position, respectively, and also to change over the first directional control valve 24*a* for the arm and the second directional control valve 24*b* for the arm into the right position and left position, respectively.

The pressure oils from the first pump 21*a* and second pump 21*b* are, therefore, fed to the rod chamber 6*b* of the boom cylinder 6 via the first directional control valve 23*a* for the boom and the second directional control valve 23*b* for the boom, and the pressure oil in the bottom chamber 6*a* is returned to the reservoir 43 via the first directional control valve 23*a* for the boom and the second directional control valve 23*b* for the boom. As a consequence, boom lowering can be performed.

Further, the pressure oils from the second pump 21*b* and first pump 21*a* are fed to the bottom chamber 7*a* of the arm cylinder 7 via the first directional control valve 24*a* for the arm and the second directional control valve 24*b* for the arm, and the pressure oil in the rod chamber 7*b* is returned to the reservoir 43 via the first directional control valve 24*a* for the arm. As a consequence, arm crowding can be performed. Namely, a combined operation of boom lowering and arm crowding can be performed.

It is to be noted that the passage 23*d* of the first directional control valve 23*a* for the boom is maintained in the closed state because of the change-over of the first directional control valve 23*a* for the boom into the left position. The pressure on the side of the boom cylinder 6 is, therefore, not fed for the acceleration of the arm cylinder 7 even if the pressure in the bottom chamber 7*a* of the arm cylinder 7 increases to a high pressure equal to or higher than the predetermined pressure and the flow combiner valve 65 is changed over into the lower position.

[Combined Operation of Boom Lowering and Arm Dumping]

The boom control device 25 and arm control device 26 are controlled to change over the first directional control valve 23*a* for the boom and the second directional control valve 23*b* for the boom into the left position and right position, respectively, and also to change over the first directional control valve 24*a* for the arm and the second directional control valve 24*b* for the arm into the left position and right position, respectively.

The pressure oils from the first pump 21*a* and second pump 21*b* are, therefore, fed to the rod chamber 6*b* of the boom cylinder 6 via the first directional control valve 23*a* for the boom and the second directional control valve 23*b* for the boom, and the pressure oil in the bottom chamber 6*a* is returned to the reservoir 43 via the first directional control valve 23*a* for the boom and the second directional control valve 23*b* for the boom. As a consequence, boom lowering can be performed.

Further, the pressure oils from the second pump 21*b* and first pump 21*a* are fed to the rod chamber 7*b* of the arm cylinder 7 via the first directional control valve 24*a* for the arm and the second directional control valve 24*b* for the arm, and the pressure oil in the bottom chamber 7*a* is returned to the reservoir 43 via the first directional control valve 24*a* for the arm and the second directional control valve 24*b* for the arm. As a consequence, arm dumping can be performed. Namely, a combined operation of boom lowering and arm dumping can be performed.

Here again, the passage 23*d* of the first directional control valve 23*a* for the boom is closed so that the pressure oil on the side of the boom cylinder 6 is not fed for the acceleration of the arm cylinder 7.

In the second embodiment constructed as described above, it is also possible, as in the above-described first embodiment, to effectively use the pressure oil which has heretofore been simply drained to the reservoir 43, in other words, the pressure oil in the rod chamber 26*a* of the boom cylinder 6, said pressure oil having been compressed to a high pressure by digging counterforce, for the acceleration of the arm cylinder 7 in a combined operation of boom raising and arm crowding. An improvement can, therefore, be brought about in the efficiency of work.

When the bottom pressure of the arm cylinder 7 has increased to a high pressure equal to or higher than the predetermined pressure upon performing a combined operation of boom raising and arm crowding, the pressure oil in the communication line 67 is guided to the main relief valve 60 via the line 69, which extends to the communication line 67, and the check valve 70. The pressure of the pressure oil guided from the boom cylinder 6 to the upstream side of the first directional control valve 24*a* for the arm is, therefore, maintained lower than the preset pressure of the overload relief valve 63. As a consequence, it is possible to realize the protection of the arm cylinder 7 from the pressure of pressure oil at the time of the above-mentioned flow combination. Accordingly, the durability of the arm cylinder 7 can be secured.

The opening area of the passage 23*d* of the first directional control valve 23*a* for the boom is provided with metering characteristics as shown in FIG. 4, so that upon combining the pressure oil to the upstream side of the first directional control valve 24*a* for the arm via the passage 23*d*, a shock which is produced upon bringing the arm cylinder 7 into operation can be reduced. It is, therefore, possible to realize the change to a smooth acceleration of the arm cylinder 7.

In the second embodiment, the passage 23*c* and passage 23*d* of the first directional control valve for the boom make up the cancellation means which cancels the operation of the pressure oil feed means including the flow combiner valve 65 to avoid the feeding of the hold-side pressure oil of the boom cylinder 6, that is, the pressure oil in the rod chamber 6*b* to the upstream side of the first directional control valve 23*a* for the arm when the control stroke of the boom control device 25 has exceeded the point P in FIG. 4 as the predetermined value. Such a cancellation means can also be arranged in the above-described first embodiment.

In this second embodiment, the arrangement of the passage 23, which can be brought into communication with the communication line 67 when the first directional control valve 23*a* for the boom has been changed over the predetermined stroke, at the right position of the first directional control valve 23*a* for the boom makes up the means that operates the pressure oil feed means including the above-mentioned flow combiner valve 65 when the boom control device 25 is controlled over the predetermined stroke. Such a means for operating the pressure feed means when the boom control device 25 is controlled over the predetermined stroke can also be arranged in the above-described first embodiment.

Figure 7:
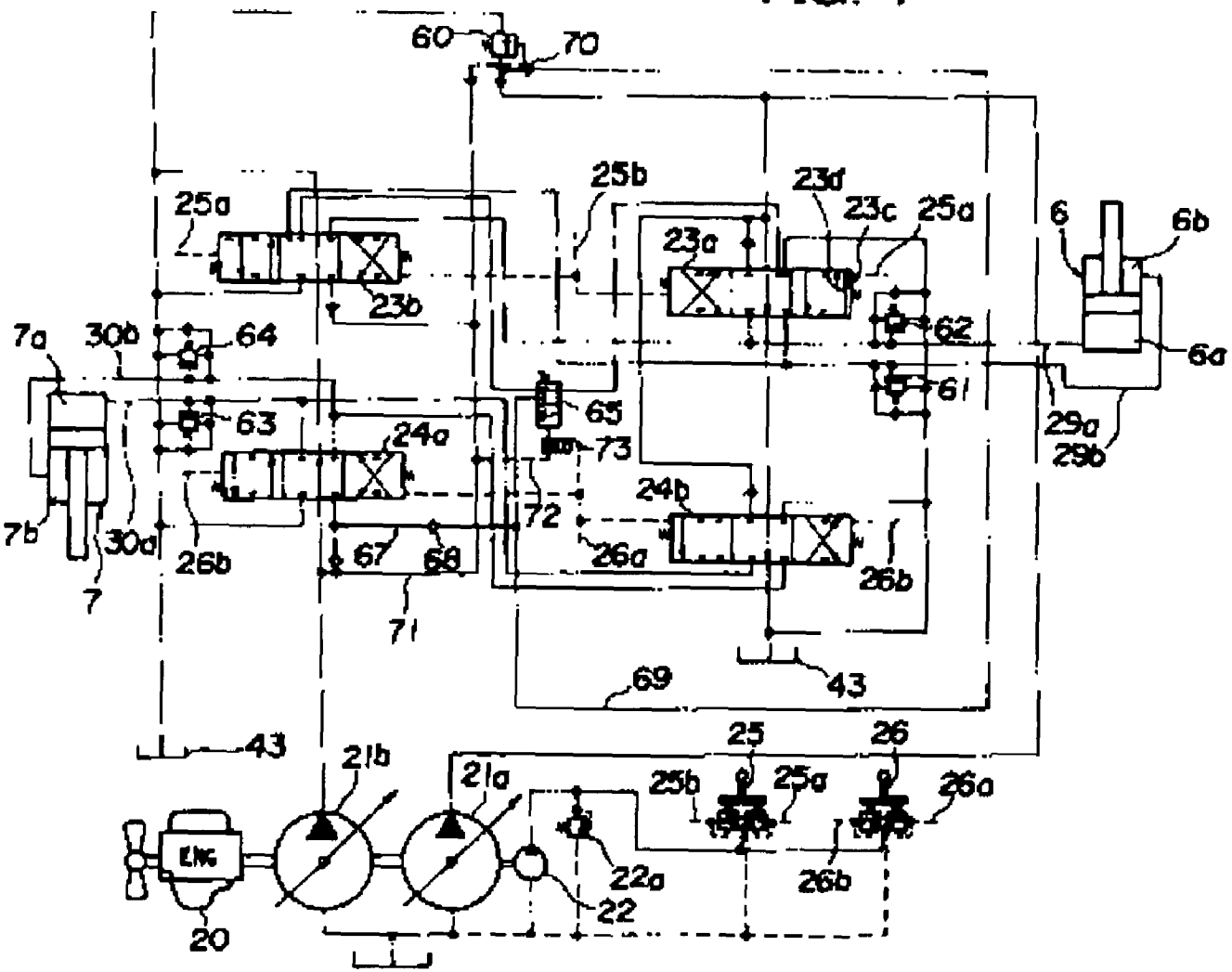
FIG. 7 is a hydraulic circuit diagram showing a third embodiment of the present invention.
Figure 8:
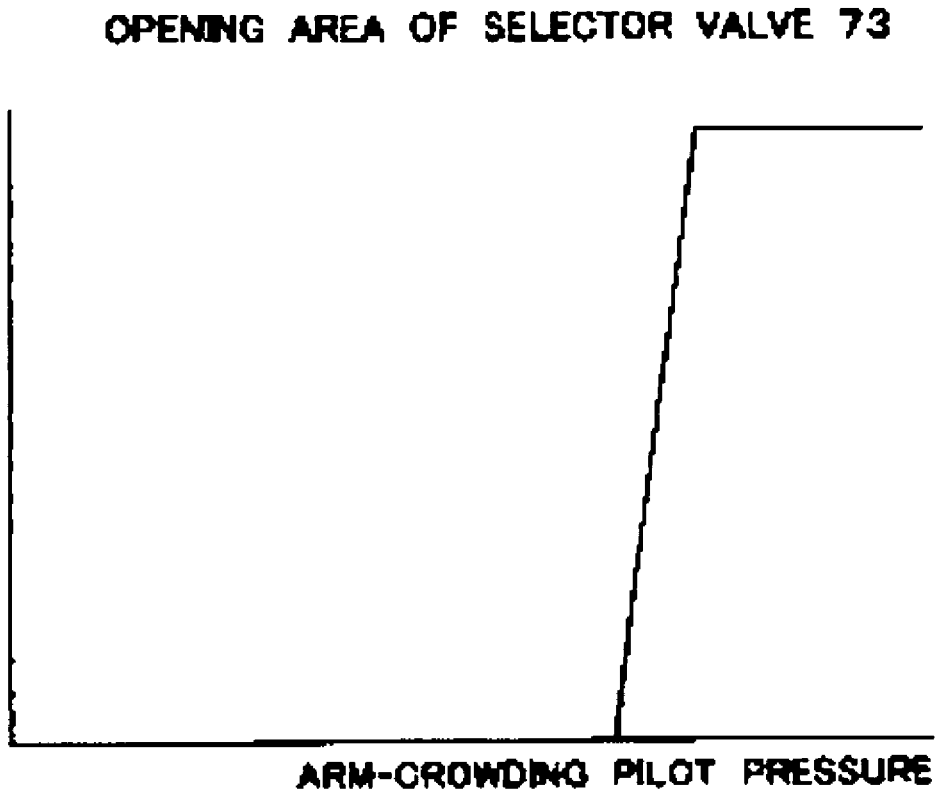
FIG. 8 is a characteristic diagram illustrating opening area characteristics of a flow combiner valve arranged in the third embodiment depicted in FIG. 7.

FIG. 7 is a hydraulic circuit diagram showing the second embodiment of the present invention, and FIG. 8 is a characteristic diagram showing opening area characteristics of a selector valve 73 arranged in the third embodiment depicted in FIG. 7.

This third embodiment is provided with a pressure oil feed means for feeding the pressure oil in the rod chamber 6*b*, said pressure oil being the hold-side pressure of the first hydraulic cylinder, i.e., the boom cylinder 6, to the upstream side of the second directional control valve, i.e., the first directional control valve 24*a* for the arm when the second control device, i.e., the arm control device 26 has been controlled over the predetermined stroke or greater and moreover, for example, the delivery pressure of the main hydraulic pump, i.e., the second pump 21*b* has increased to a high pressure equal to or higher than the predetermined pressure.

This pressure oil feed means is composed of the communication line 67, the check valve 68, the flow combiner valve 65, a line extending to the delivery line of the second pump 21*b*, a control line 72 for taking the pressure out of the line 71 as a control pressure and guiding it to the control chamber of the flow combiner valve 65, and the selector valve 73 arranged on the control line 72. The selector valve 73 is equipped with such characteristics that as illustrated in FIG. 8, the selector valve 73 opens when the control stroke of the arm control device 26 is equal to or greater than the predetermined stroke, in other words, the pilot pressure corresponding to the control stroke for arm crowding is equal to or greater than the predetermined pressure. The remaining construction is equivalent to the above-described second embodiment.

In the third embodiment constructed as described above, substantially the same operations as in the above-described second embodiment are performed with respect to a single boom operation, a single arm operation, a combined operation of boom raising and arm dumping, a combined operation of boom lowering and arm crowding, and a combined operation of boom lowering and arm dumping.

In a boom-raising operation among single boom operations, no arm-crowding operation is performed so that the selector valve 73 is held in the closed position. Accordingly, the flow combiner valve 65 is not changed over and is held in the upper position shown in FIG. 7.

In a single boom-lowering operation and a combined operations of boom lowering and the arm, the passage 23*d* of the first directional control valve 23*a* for the boom is maintained in the closed state so that the passage 23*d* and the communication line 67 are maintained out of communication. The pressure oil on the side of the boom cylinder 6 is, therefore, not fed for the acceleration of the arm cylinder 7 upon performing a combined operation of boom lowering and the arm.

Upon performing an arm-crowding operation among the single arm operations, a pilot pressure which is produced in the pilot line 26 as a result of a control of the arm control device 26 changes over the selector valve 73 into the open position. When the delivery pressure of the second pump 21*b* increases to a high pressure equal to or higher than the predetermined pressure, the high pressure is applied to the control chamber of the flow combiner valve 65 via the line 71, control line 72 and selector valve 73, and the selector valve 65 is changed over into the lower position in FIG. 7. Therefore, the communication line 67 connected to the upstream side of the first directional control valve 24*a* for the arm is brought into an open state. As the first directional control valve 23*a* for the boom has not been changed over at this time, however, the passage 23*d* of the first directional control valve 23*a* for the boom, said passage 23*d* being capable of communicating to the communication line 67, is in the closed state, in other words, in such a state that the passage 23*d* is not brought into communication with the communication line 67.

Further, in the case of a single arm-dumping operation or a combined operation of arm dumping and the boom, the selector valve 73 takes the closed position because no arm-crowding operation is performed. The flow combiner valve 65 is, therefore, held in the upper position shown in FIG. 7 so that the communication line 67 remains in the closed state. Upon performing a combined operation of arm dumping and the boom, the pressure oil on the side of the boom cylinder 6 is, therefore, not fed for its combination to the arm cylinder 7.

[Combined Operation of Boom Raising and Arm Crowding]

Upon performing a combined operation of boom raising and arm crowding, the boom control device 25 is controlled to change over the first directional control valve 23*a* for the boom and the second directional control valve 23*b* for the boom into the right position and the left position, respectively, and the arm control device 26 is controlled to change over the first directional control valve 24*a* for the arm and the second directional control valve 24*b* for the arm into the right position and the left position, respectively.

As a result, the pressure oil from the first pump 21*a* and the pressure oil from the second pump 21*b* are fed to the main line 29*a* via the first directional control valve 23*a* for the boom and the second directional control valve 23*b* for the boom, respectively, and are then fed to the bottom chamber 6*a* of the boom cylinder 6. The pressure oil in the rod chamber 6*b* of the boom cylinder 6 flows out to the main line 29*b*.

Further, the pressure oil from the second pump 21*b* and the pressure oil from the first pump 21*a* are fed to the main line 30*a* via the first directional control valve 24*a* for the arm and the second directional control valve 24*b* for the arm, respectively, and are then fed to the bottom chamber 7*a* of the arm cylinder 7. The pressure oil in the rod chamber 7*b* of the arm cylinder 7 is returned to the reservoir 43 via the main line 30*b* and the first directional control valve 24*a* for the arm. As a consequence, arm crowding can be performed.

If the control stroke of the arm control device 26 is relatively small in the combined operation of boom raising and arm crowding, the pilot pressure applied to the selector valve 73 is relatively low so that it does not reach the change-over pressure. Therefore, the selector valve 73 is maintained in the closed position, and the flow combiner valve 65 is held in the upper position in FIG. 7. As a consequence, the communication line 67 is closed, and the pressure oil on the side of the boom cylinder 6 is not fed to the arm cylinder 7 for its combination.

Even if the delivery pressure of the second pump 21*b* increases to a high pressure equal to or higher than the predetermined pressure when the control stroke of the arm control device 26 is relatively small as described above, the flow combiner valve 65 is held in the upper position in FIG. 7 because the selector valve 73 is maintained in the closed position. In such a case, the pressure on the side of the boom cylinder 6 is, therefore, not fed to the arm cylinder 7 for its combination even when the delivery pressure of the second pump 21*b* increases to a high pressure.

When the control stroke of the arm control device 26 increases to the predetermined stroke or greater, the pilot pressure to be applied to the selector valve 73 becomes higher so that the selector valve 73 is changed over into the open position.

When the delivery pressure of the second pump 21*b* is lower than the predetermined pressure in the above-described case, the pressure applied to the control chamber of the flow combiner valve 65 via the line 71, control line 72 and selector valve 73 is low so that the flow combiner valve 65 is held in the upper position shown in FIG. 7 without any change-over. Accordingly, the communication line 67 is closed, and the pressure oil on the side of the boom cylinder 6 is not fed to the arm cylinder 7.

When the control stroke, for example, of the boom control device 25 is relatively small in the state that as mentioned above, the flow combiner valve 65 is held in the upper position in FIG. 7 and the communication line 67 is closed, the passage 23*c* of the first directional control valve 23*a* for the boom is closed as mentioned above although the passage 23*d* is opened. The pressure oil flowed out to the main line 29*b* is, therefore, guided to the second directional control valve 23*b* for the boom via the passage 23*d* of the first directional control valve 23*a* for the boom and the flow combiner valve 65 held in the upper position shown in FIG. 3, and is then returned from the second directional control valve 23*b* for the boom to the reservoir 43. As a result, a precise boom-raising operation or the like can be performed. Namely, a combined operation of boom raising, including a precise operation, and arm crowding can be performed.

This third embodiment is characterized especially by a combined operation with boom raising when, in a state that the control stroke of the arm control device 26 has increased to the predetermined stroke or greater and the selector valve 73 has been changed over into the open position as mentioned above, the delivery pressure of the second pump 21*b* increases to a high pressure equal to or higher than the predetermined pressure, the flow combiner valve 65 is changed over into the lower position in FIG. 7 against the spring force, and the communication line 67 is opened to establish a communicated state.

When the control stroke of the boom control device 25 is relatively small in the state that the communication line 67 is in communication as described above, in other words, when the passage 23*d* shown in FIG. 3 opens but the passage 23*c* also depicted in FIG. 3 is so small that it does not open, the pressure oil in the rod chamber 6*b* of the boom cylinder 6, said pressure oil having been guided to the main line 29*b* as mentioned above, is fed to the upstream side of the first directional control valve 24*a* for the arm via the passage 23*d* of the first directional control valve 23*a* for the boom, the flow combiner valve 65 changed over into the lower position, the communication line 67 and the check valve 68. In other words, the pressure oil flowed out of the rod chamber 6*b* of the boom cylinder 6 and the pressure oil from the second pump 21*b* are combined and fed to the first directional control valve 24*a* for the arm, and are then fed to the bottom chamber 7*a* of the arm cylinder 7. As a result, the arm cylinder 7 is accelerated so that arm crowding can be performed at a high speed. Namely, a combined operation of boom raising and accelerated arm crowding can be performed.

When the control stroke of the boom control device 25 is large, for example, in the above-mentioned combined operation of boom raising and arm crowding, the passage 23*c* of the first directional control valve 23*a* for the boom is brought into communication with the reservoir 43 as mentioned above in connection with the second embodiment described above. Even if the flow combiner valve 65 has been changed over into the lower position, the pressure oil flowed out of rod chamber 6*b* of the boom cylinder 6 is not used for the acceleration of the arm cylinder 7 unlike the above-described operation. Namely, a combined operation of boom raising and arm crowding can be performed including an operation of the arm cylinder 7 only by the pressure oils from the first and second pumps 21*a*,21*b* as mentioned above.

By changing over the flow combiner valve 65, the third embodiment constructed as described above can bring about similar advantageous effects as in the second embodiment.

In particular, the flow combiner valve 65 is changed over into the lower position in FIG. 7, which permits a combination of flows, only when the control stroke of the arm control device 26 is equal to or greater than the predetermined stroke and moreover, the delivery pressure of the second pump 21*b* has increased to a high pressure equal to or higher than the predetermined pressure. The time point at which the arm cylinder 7 is accelerated can, therefore, be maintained constant with high accuracy, thereby making it possible to heighten the accuracy of control on the acceleration of the arm cylinder 6 in this combined operation of boom raising and arm crowding.

In the above-described third embodiment, the delivery pressure of the second pump 21*b* at the time that it has increased to a high pressure equal to or higher than the predetermined pressure is used as a change-over pressure for the selector valve 73. The third embodiment may, however, be constructed in such a way that instead of the delivery pressure of the second pump 21*b*, the pressure in the bottom chamber 7 of the arm cylinder 7 at the time that it has increased to a high pressure equal to or higher than the predetermined pressure is employed as a change-over pressure for the selector valve 73.

Figure 9:
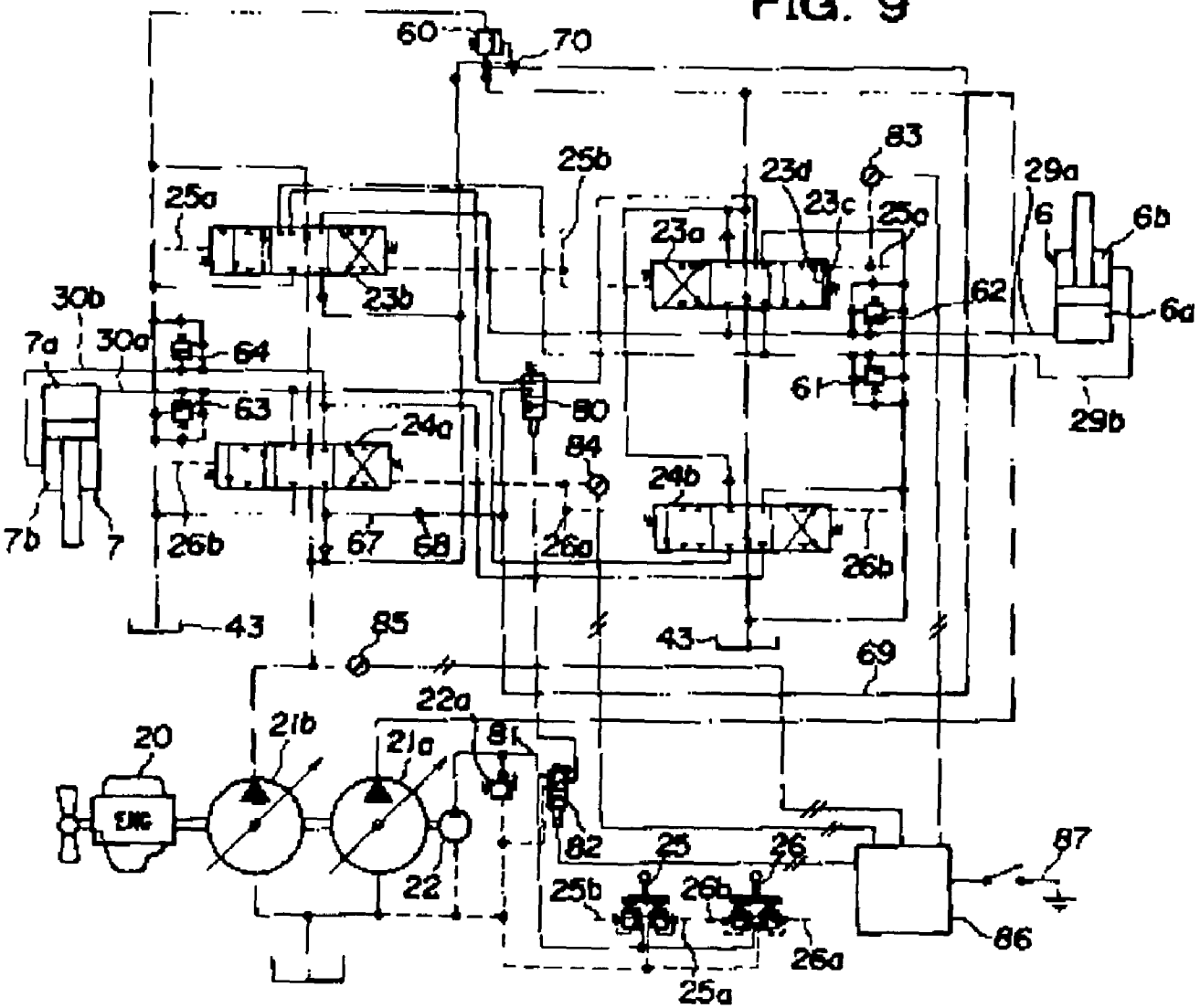
FIG. 9 is a hydraulic circuit diagram showing a fourth embodiment of the present invention.
Figure 10:
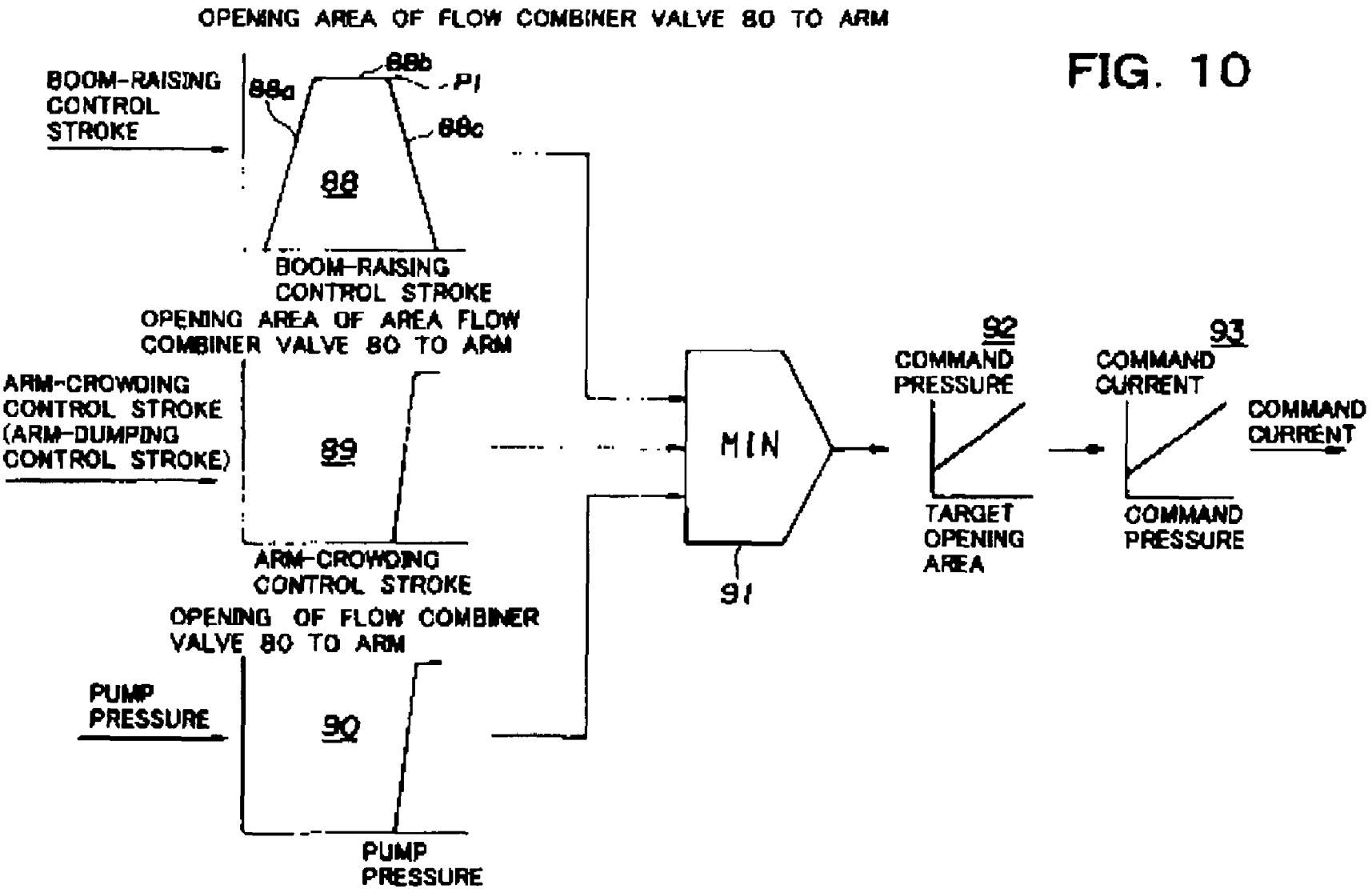
FIG. 10 is a control flow diagram including the construction of an essential part of a controller arranged in the fourth embodiment shown in FIG. 9.

FIG. 9 is a hydraulic circuit diagram showing a fourth embodiment of the present invention, and FIG. 10 is a control flow diagram including the construction of an essential part of a controller arranged in the fourth embodiment shown in FIG. 9.

This fourth embodiment is provided with a control stroke detection means for detecting a control stroke of the first control device, i.e., the boom control device 25 upon raising the boom, namely, a boom-raising control stroke sensor 83, a control stroke detection means for detecting a control stroke of the second control device, i.e., the arm control device 26 upon crowding the arm, namely, an arm-crowding control stroke sensor 84, and a pump delivery pressure detection means for detecting a delivery pressure of the main hydraulic pump, i.e., the second pump 21*b*, namely, a delivery pressure sensor 85.

The fourth embodiment is also provided with a controller 86 and a mode switch 87. The controller 86 outputs a signal responsive to a boom-raising control stroke detected by the boom-raising control stroke sensor 83, an arm-crowding stroke detected by the arm-crowding stroke sensor 84, and a delivery pressure of the second pump 21*b* as detected by the delivery pressure sensor 85.

Also arranged are a flow combiner valve 80 and a proportional solenoid valve 82. The flow combiner valve 80 is arranged on the communication line 67 and is changed over by a control pressure. The proportional solenoid valve 82 can feed the pressure of a pilot line 81, which is connected to the delivery line of the pilot pump 22, as a control pressure to the control chamber of the flow combiner valve 80, and is operated responsive to a signal outputted from the controller 86.

The above-described communication line 67, the check valve 68 arranged on the communication line 67, the flow combiner valve 80, the pilot line 81 and the proportional solenoid valve 82 makes up a pressure oil fed means which, when the second control device, i.e., the arm control device 26 has been controlled over the predetermined stroke or greater and moreover, when the delivery pressure, for example, of the main hydraulic pump, i.e., the second pump 21*b* has increased to the predetermined pressure or higher, feeds the hold-side pressure oil of the first hydraulic cylinder, i.e., the boom cylinder 6, namely, the pressure oil in the rod chamber 6*b* to the upstream side of the second directional control valve, i.e., the first directional control valve 24*a* for the arm.

As illustrated in FIG. 10, the above-mentioned controller 86 is provided with tables 88,89,90. Responsive to a boom-raising control stroke, the table 88 outputs a signal corresponding to an opening area of the flow combiner valve 90 to the arm, namely, a signal corresponding to an opening area to the communication line 67 connected to the first directional control vale 24*a* for the arm. Responsive to an arm-crowding control stroke, the table 89 outputs a signal corresponding to an opening area of the flow combiner valve 80 to the arm, namely, a signal corresponding to an opening area to the communication line 67. Responsive to a delivery pressure of the second pump 21*b*, the table 90 outputs a signal corresponding to an opening area of the flow combiner valve 80 to the arm, namely, a signal corresponding to an opening area to the communication line 67.

The controller is also provided with a minimum selector 91 and tables 92, 93. The minimum selector 91 selects one having the minimum value from the signals outputted from the above-described tables 88, 89, 90, and outputs it as a target opening. The table 92 computes a command pressure corresponding to the target opening selected by the minimum selector 91. The table 93 computes and outputs a command current corresponding to the command pressure determined by the table 92.

The above-mentioned mode switch 87 is composed of a switch, which can select one of an acceleration mode that enables an operation of the above-mentioned pressure oil feed means, which includes the flow combiner valve 80, the proportional solenoid valve 82 and the like, and a non-acceleration mode that disables the operation of the pressure oil feed means.

The remaining construction is equivalent to the above-described third embodiment.

In the above-described construction, the features that in the table 88 of the controller 86, the opening area of the flow combiner valve 80 is gradually increased (a range 88*a* in FIG. 10) when the boom-raising control stroke exceeds a predetermined stroke and is then set at a constant large opening area (a range 88*b* in FIG. 10) makes up, together with the passage 23*d* arranged in the first directional control valve 23*a* for the boom, a means for operating the above-described pressure oil feed means which includes the flow combiner valve 80.

In the above-described construction, the feature that in the table 88 of the controller 86, the opening area of the flow combiner valve 80 is gradually decreased from the preceding constant opening area when the boom-raising control stroke exceeds another predetermined stroke and is eventually decreased to zero (0) (a range 88*c* in FIG. 10) makes up, together with the passage 23*c* arranged in the first directional control valve 23*a* for the boom, a cancellation means for canceling the operation of the above-described pressure oil feed means, which includes the flow combiner valve 80, to avoid the feeding of the hold-side pressure oil of the boom cylinder 6, namely, the pressure oil in the rod chamber 6*b* to the upstream side of the first directional control valve 23*a* for the arm when the control stroke of the boom control device 25 exceeds the predetermined value (a boundary point P1 between the range 88*b* and the range 8*c* in FIG. 10).

In the fourth embodiment constructed as described above, during a single boom operation, a single arm operation, a combined operation of boom raising and arm dumping, a combined operation of boom lowering and arm crowding or a combined operation of boom lowering and arm dumping, the signal value selected at the minimum selector 91 in the controller 86 is 0, the proportional solenoid valve 82 shown in FIG. 9 is held in the upper position depicted in FIG. 9, and as a consequence, the flow combiner valve 80 is held in the upper position shown in FIG. 9. The valve operations conducted upon performing the above-mentioned working operations are substantially the same as in the above-described third embodiment.

[Combined Operation of Boom Raising and Arm Crowding]

In a state that the mode switch 87 has been set in the acceleration mode to perform an acceleration of the arm cylinder 7, for example, upon performing a combined operation of boom raising and arm crowding, the boom control device 25 is controlled to change over the first directional control valve 23*a* for the boom and the second directional control valve 23*b* for the boom into the right position and the left position, respectively, and the arm control device 26 is controlled to change over the first directional control valve 24*a* for the arm and the second directional control valve 24*b* for the arm into the right position and the left position, respectively.

As a result, as in the above-described third embodiment, the pressure oil from the first pump 21*a* and the pressure oil from the second pump 21*b* are fed to the main line 29*a* via the first directional control valve 23*a* for the boom and the second directional control valve 24*b* for the boom, respectively, and are then fed to the bottom chamber 6*a* of the boom cylinder 6. The pressure oil in the rod chamber 6*b* of the boom cylinder 6 flows out to the main line 29*b*.

Further, the pressure oil from the second pump 21*b* and the pressure oil from the first pump 21*a* are fed to the main line 30*a* via the first directional control valve 24*a* for the arm and the second directional control valve 24*b* for the arm, respectively, and are then fed to the bottom chamber 7*a* of the arm cylinder 7. The pressure oil in the rod chamber 7*b* of the arm cylinder 7 is returned to the reservoir 43 via the main line 30*b* and the first directional control valve 24*a* for the arm. As a consequence, arm crowding can be performed.

During the above-described operation, the pressure in the pilot line 25*a*, said pressure corresponding to the control stroke of the boom control device 25, is detected by the boom-raising control stroke sensor 83; the pressure in the pilot line 26*a*, said pressure corresponding to the control stroke of he arm control device 26, is detected by the arm-crowding control stroke sensor 84; and the delivery pressure of the second pump 21*b* is detected by the delivery pressure sensor 85. These signals are then inputted to the controller 86.

Now assume, for example, that the control stroke of the boom control device 25 is relatively small and falls within the upgrade range 88*a* in the table 88 of FIG. 10 although the control stroke of the arm control device 26 is large and the delivery pressure of the second pump 21*b* has increased to a high pressure equal to or higher than the predetermined pressure. The relatively small signal value outputted from the boom-raising control stroke sensor 83 is selected at the minimum value at the minimum selector 91 in the controller 86 so that a target opening corresponding to the signal value is outputted to the table 92. The table 92 computes a command pressure corresponding to the thus-inputted target opening, and outputs it to the table 93. The table 93 outputs a relatively small command current corresponding to the thus-inputted command pressure. This command current is outputted to the proportional solenoid valve 82 depicted in FIG. 9.

Responsive to the above-mentioned relatively small command current, the proportional solenoid valve 82 opens to an extent not reaching the fully-opened position to output a control pressure—which has been produced by using, as a primary pressure, the delivery pressure of the pilot pump 22 as guided via the pilot line 81—to the control chamber of the flow combiner valve 80. The force produced, for example, by the control pressure outputted from the proportional solenoid valve 82 is now smaller than the spring force, so that the flow combiner valve 80 is held in the upper position shown in FIG. 9. Namely, the communication line 67 is maintained in the closed state.

As the control stroke of the boom control device 25 is relative small at this time, the passage 23*c* of the first directional control valve 23*a* for the boom is maintained in the closed state although the passage 23*d* is opened, as mentioned above. Therefore, the pressure oil which has flowed out to the main line 29*b* is guided to the second directional control valve 23*b* for the boom via the passage 23*d* of the first directional control valve 23*a* for the boom and the flow combiner valve 80 held in the upper position shown in FIG. 9, and is then returned from the second directional control valve 23*b* for the boom to the reservoir 43. As a result, a precise boom-raising operation can be performed. Namely, a combined operation of boom raising, including a precise operation, and arm crowding can be performed.

Also assume that, in a state that the control stroke of the arm control device 26 is large and the delivery pressure of the second pump 21*b* has increased to a high pressure equal to or higher than the predetermined pressure, the control stroke of the boom control device 25 becomes relatively large and falls within the horizontal range 88*b* in the table 88 depicted in FIG. 10, in other words, the control stroke is small enough to maintain, for example, the passage 23*c* of the first directional control valve 23*c* for the boom in the closed state although the passage 23*d* is open. As the minimum value, the minimum selector 91 then selects, for example, the signal value outputted from the boom-raising control stroke sensor 83. Responsive to this minimum value, computations are conducted at the tables 92, 93 as mentioned above, and a large command current is outputted from the controller 86 to the proportional solenoid valve 82 shown in FIG. 9.

Responsive to the large command current, the proportional solenoid valve 82 is operated such that it is brought into the fully-opened position. As a result, a large control pressure is outputted to the control chamber of the flow combiner valve 80 via the proportional solenoid valve 82. Force produced by the control pressure, therefore, overcomes the spring force so that the flow combiner valve 80 is changed over into the lower position in FIG. 9. As a consequence, the communication line 67 is opened.

At this time, the pressure oil in the rod chamber 6*b* of the boon cylinder 6, said pressure oil having been guided to the main line 29*b*, is fed to the upstream side of the first directional control valve 24*a* for the arm via the passage 23*d* of the first directional valve 23*a* for the boom, the flow combiner valve 65 changed over into the lower position, the communication line 67 and the check valve 68. In other words, the pressure oil in the rod chamber 6*b* of the boom cylinder 6 and the pressure oil from the second pump 21*b* are combined and fed to the first directional control valve 24*a* for the arm, and are then fed to the bottom chamber 7*a* of the arm cylinder 7. As result, it is possible to accelerate the arm cylinder 7 and hence, to perform arm crowding at a higher speed. Namely, a combined operation of boom raising and accelerated arm crowding can be performed.

Also assume that, in a state that the control stroke of the arm control device 26 is large and the delivery pressure of the second pump 21*b* has increased to a high pressure equal to or higher than the predetermined pressure, the boom control stroke has become large and falls, for example, within a lower section of the downgrade range 88*c* in the table 88 shown in Table 10, in other words, the boom control stroke has become such a large control stroke as bringing the passage 23*c* of the first directional control valve 23*a* for the boom into communication with the reservoir 43. As the minimum value, the minimum selector 91 then selects the signal value outputted from the boom-raising control stroke sensor 83. Responsive to this minimum value, computations are conducted at the tables 92, 93, and a small command current, for example, a command current close to zero (0) in terms of signal value is outputted from the controller 86 to the proportional solenoid valve 82.

Responsive to this small command current, the proportional solenoid value 82 is held, for example, in the upper position shown in FIG. 9. Accordingly, the control pressure which is applied to the control chamber of the flow combiner valve 80 via the proportional solenoid valve 82 is as low as the reservoir pressure so that the flow combiner valve 80 is held in the upper position shown in FIG. 9. Namely, the communication line 67 is closed.

The pressure oil flowed out from the rod chamber 6*b* of the boom cylinder 6 to the main line 29*b* is, therefore, returned to the reservoir via the passage 23*c* of the first directional control valve 23*a* for the boom and the second directional control valve 23*b* for the boom. Namely, the pressure oil flowed out to the main line 29*b* is not used for the acceleration of the arm cylinder 7. In this case, a combined operation of boom raising and arm crowding, which involves an operation of the arm cylinder 7 only by the pressure oils from the first and second pumps 21*a*,21*b*, can be performed.

It is to be noted that, when the mode switch 87 illustrated in FIG. 9 is changed over into the non-acceleration mode, no acceleration of the arm cylinder 7 is effected upon performing a combined operation of boom raising and arm crowding because the flow combiner valve 80 is held in the upper position in FIG. 9 and the communication line 67 is closed.

Now assume that with the mode switch 87 changed over into the acceleration mode in the fourth embodiment constructed as described above, the arm control device 26 is controlled over the predetermined stroke or greater, the boom control device 25 is controlled to such an extent as not reaching the maximum control stroke, and the delivery pressure of the second pump 21*b* has increased to a high pressure equal to or higher than the predetermined pressure. The flow combiner valve 90 is then changed over into the lower position in FIG. 9 so that the pressure oil on the side of the boom cylinder 6 can be fed, as a flow to be combined, to the first directional control valve 24*a* for the arm. Namely, similar advantageous effects as in the above-described third embodiment can be brought about.

Especially by changing over the mode switch 87, it is possible to selectively deal with work, which requires an acceleration of the arm cylinder 7, and work, which requires no acceleration of the arm cylinder 7. The fourth embodiment, therefore, has excellent working capability.

The above-described embodiments are constructed to effect an acceleration upon performing a combined operation of boom raising and arm crowding. It is, however, possible to construct such that a table similar to the table 89 in FIG. 10 is arranged in connection with the arm-dumping control stroke, an arm-dumping control stroke sensor is arranged to detect the pressure in the pilot line 26*b* in FIG. 9, and upon performing a combined operation of boom raising and arm dumping, an acceleration of the arm cylinder 7 is effected.

In each of the above-described embodiments, an acceleration of the arm cylinder 7 is realized upon performing a combined operation of boom raising and arm crowding or a combined operation of boom raising and arm dumping. The present invention is, however, not limited to the acceleration of the arm cylinder 7. Specifically, upon performing a combined operation of the boom and a bucket, a bucket cylinder can be accelerated by feeding the pressure oil on the side of the boom cylinder, which constitutes the first hydraulic cylinder, to the bucket cylinder which constitutes the second hydraulic cylinder. Upon performing a combined operation of the arm and the bucket, the bucket cylinder can be accelerated by feeding the pressure oil on the side of the arm cylinder, which constitutes the first hydraulic cylinder, to the bucket cylinder which constitutes the second hydraulic cylinder. When an attachment for special work is arranged on the free end of the arm in place of the bucket, an attachment-driving actuator can be accelerated upon performing a combined operation of the arm and the attachment by feeding the pressure oil on the side of the arm cylinder, which constitutes the first hydraulic cylinder, to the attachment-driving actuator which constitutes the second hydraulic cylinder.

The invention claimed is:

1. A hydraulic drive system provided with:

a main hydraulic pump, a first hydraulic cylinder and second hydraulic cylinder driven by pressure oil delivered from said main hydraulic pump, a first directional control valve for controlling a flow of pressure oil to be fed from said main hydraulic pump to said first hydraulic cylinder, a second directional control valve for controlling a flow of pressure oil to be fed from said main hydraulic pump to said second hydraulic cylinder, a first control device for selectively controlling said first directional control valve, and a second control device for selectively controlling said second directional control valve, wherein:

said hydraulic drive system is provided with a pressure oil feed means for feeding hold-side pressure oil in said first hydraulic cylinder to an upstream side of said second directional control valve when a drive-side pressure of said second hydraulic cylinder has increased to a high pressure equal to or higher than a predetermined pressure.

2. A hydraulic drive system according to claim 1, wherein said main hydraulic pump comprises a first hydraulic pump capable of feeding pressure oil to said first hydraulic cylinder and said second hydraulic cylinder and a second hydraulic pump capable of feeding pressure oil to said first hydraulic cylinder, said first directional control valve comprises two directional control valves, one being interposed between said first pump and said first hydraulic cylinder, and the other being interposed between said second pump and said first hydraulic cylinder, and said second directional control valve comprises two directional control valves, one being interposed between said first pump and said second hydraulic cylinder, and the other being interposed between said second pump and said second hydraulic cylinder.

3. A hydraulic drive system according to claim 2, wherein at least one of said two directional control valves which make up said first directional control valve is provided with a passage to said pressure feed means which feeds the hold-side pressure oil in said first hydraulic cylinder to said upstream side of said second directional control valve and also with a passage which guides said hold-side pressure oil in said first hydraulic cylinder to a reservoir, and said hold-side pressure oil in said first hydraulic cylinder is selectively controlled by said first directional control valve to feed it to said upstream side of said second directional control valve.

4. A hydraulic drive system according to claim 2, wherein at least one of said two directional control valves which make up said first directional control valve is provided with a passage to said pressure feed means which feeds the hold-side pressure oil in said first hydraulic cylinder to said upstream side of said second directional control valve and also with a passage which guides said hold-side pressure oil in said first hydraulic cylinder to a reservoir, and said passage of said first directional control valve, which feeds the hold-side pressure oil in said first hydraulic cylinder to said upstream side of said second directional control valve, is fully opened from a state that said first control device has been controlled over at most a predetermined stroke.

5. A hydraulic drive system according to claim 2, wherein at least one of said two directional control valves which make up said first directional control valve is provided with a passage to said pressure feed means which feeds the hold-side pressure oil in said first hydraulic cylinder to said upstream side of said second directional control valve and also with a passage which guides said hold-side pressure oil in said first hydraulic cylinder to a reservoir, and said passage of said first directional control valve, which feeds the hold-side pressure oil in said first hydraulic cylinder to said reservoir, begins to open from a state that said first control device has been controlled over at least a predetermined stroke.

6. A hydraulic drive system according to claim 1, wherein said hydraulic drive system is provided with a main relief valve for controlling a maximum pressure of said hydraulic pump and an overload relief valve for controlling maximum pressures of said first hydraulic cylinder and second hydraulic cylinder, respectively, said overload relief valve being set at a preset pressure higher than said main relief valve, said pressure oil feed means is provided with a communication line for guiding the hold-side pressure oil in said first hydraulic cylinder to said upstream side of said second directional control valve, and a line is arranged to guide pressure oil in said communication line to said main relief valve.

7. A hydraulic drive system according to claim 1, wherein said hydraulic drive system is provided with a cancellation means for canceling an operation of said pressure oil feed means to prevent feeding the hold-side pressure oil in said first hydraulic cylinder to said upstream side of said second directional control valve when a control stroke of said first control device has exceeded a predetermined value.

8. A hydraulic drive system according to claim 1, wherein said hydraulic drive system is provided with a means for operating said pressure oil feed means when said first control device has been controlled over a predetermined stroke.

9. A hydraulic drive system according to claim 1, wherein the hold-side pressure oil in said first hydraulic cylinder is selectively controlled by said first directional control valve to feed it to said upstream side of said second directional control valve.

10. A hydraulic drive system according to claim 1, wherein said first hydraulic cylinder comprises a boom cylinder, and said second hydraulic cylinder comprises an arm cylinder.

11. A hydraulic drive system provided with:

a main hydraulic pump, a first hydraulic cylinder and second hydraulic cylinder driven by pressure oil delivered from said main hydraulic pump, a first directional control valve for controlling a flow of pressure oil to be fed from said main hydraulic pump to said first hydraulic cylinder, a second directional control valve for controlling a flow of pressure oil to be fed from said main hydraulic pump to said second hydraulic cylinder, a first control device for selectively controlling said first directional control valve, and a second control device for selectively controlling said second directional control valve, wherein:

said hydraulic drive system is provided with a pressure oil feed means for feeding hold-side pressure oil in said first hydraulic cylinder to an upstream side of said second directional control valve when said second control device has been controlled over at least a predetermined stroke.

12. A hydraulic drive system according to claim 11, wherein said pressure oil feed means feeds the hold-side pressure oil in said first hydraulic cylinder to said upstream side of said second directional control valve when a delivery pressure of said main hydraulic pump has increased to a high pressure equal to or higher than a predetermined pressure.

13. A hydraulic drive system according to claim 12, wherein said hydraulic drive system is provided with a control stroke detection means for detecting a control stroke of said second control device and a pump delivery pressure detection means for detecting the delivery pressure of said main hydraulic pump, and a controller for outputting a signal to operate said pressure oil feed means in accordance with the control stroke of said second control device as detected by said control stroke detection means and the delivery pressure of said main hydraulic pump as detected by said pump delivery pressure detection means.

14. A hydraulic drive system according to claim 13, wherein said hydraulic drive system is provided with a mode switch capable of selecting one of a mode, which enables an operation of said pressure oil feed means, and another mode, which disables an operation of said pressure oil feed means.

* * * * *